US008749477B2

(12) United States Patent
Miyazaki

(10) Patent No.: US 8,749,477 B2
(45) Date of Patent: Jun. 10, 2014

(54) METHOD OF DRIVING ELECTROPHORETIC DISPLAY DEVICE, ELECTROPHORETIC DISPLAY DEVICE, AND ELECTRONIC APPARATUS

(75) Inventor: Atsushi Miyazaki, Suwa (JP)

(73) Assignee: Seiko Epson Corporation (JP)

( * ) Notice: Subject to any disclaimer, the term of this patent is extended or adjusted under 35 U.S.C. 154(b) by 848 days.

(21) Appl. No.: 12/331,510

(22) Filed: Dec. 10, 2008

(65) Prior Publication Data

US 2009/0195566 A1 Aug. 6, 2009

(30) Foreign Application Priority Data

Feb. 1, 2008 (JP) ..... 2008-023029

(51) Int. Cl.
*G09G 3/34* (2006.01)

(52) U.S. Cl.
USPC ..... 345/107; 359/228; 359/296

(58) Field of Classification Search
USPC ..... 345/84, 107; 359/228, 296
See application file for complete search history.

(56) References Cited

U.S. PATENT DOCUMENTS

| | | | | |
|---|---|---|---|---|
| 6,650,462 | B2 * | 11/2003 | Katase | 359/296 |
| 7,019,889 | B2 * | 3/2006 | Katase | 359/296 |
| 7,034,783 | B2 * | 4/2006 | Gates et al. | 345/84 |
| 7,359,110 | B2 * | 4/2008 | Katase | 359/296 |
| 7,542,024 | B2 * | 6/2009 | Koyama | 345/107 |
| 7,973,761 | B2 * | 7/2011 | Yokoo et al. | 345/107 |
| 8,098,228 | B2 * | 1/2012 | Shimodaira et al. | 345/107 |
| 8,294,663 | B2 * | 10/2012 | Miyazaki | 345/107 |
| 2002/0021483 | A1 * | 2/2002 | Katase | 359/267 |
| 2003/0048370 | A1 * | 3/2003 | Koyama | 348/311 |
| 2006/0028427 | A1 * | 2/2006 | Katase | 345/107 |
| 2006/0209011 | A1 * | 9/2006 | Miyasaka | 345/107 |
| 2006/0244713 | A1 | 11/2006 | Zhou et al. | |
| 2007/0030243 | A1 | 2/2007 | Ishii | |
| 2007/0080928 | A1 * | 4/2007 | Ishii et al. | 345/107 |
| 2007/0120816 | A1 * | 5/2007 | Yokoo et al. | 345/107 |
| 2007/0176889 | A1 * | 8/2007 | Zhou et al. | 345/107 |

(Continued)

FOREIGN PATENT DOCUMENTS

| | | |
|---|---|---|
| JP | 03-213827 | 9/1991 |
| JP | 2002-116733 | 4/2002 |

(Continued)

*Primary Examiner* — Jason Mandeville
(74) *Attorney, Agent, or Firm* — Harness, Dickey & Pierce, P.L.C.

(57) ABSTRACT

An electrophoretic display device driving method includes: applying a first voltage between a first electrode and a common electrode to display a highest or lowest gray scale at a first pixel, subsequently applying a second voltage between a second electrode and the common electrode to display an intermediate gray scale at a second pixel, and subsequently applying a third voltage between a third electrode and the common electrode to display the other of the highest and lowest gray scale at a third pixel; then, with each electrode in a high-impedance state, applying a first auxiliary voltage between one of the first and third electrodes and the common electrode; and thereafter, applying a second auxiliary voltage between the other of the first and third electrode and the common electrode, the second electrode is in the high-impedance state while the auxiliary voltages are applied to the first and third electrodes.

9 Claims, 12 Drawing Sheets

(56) References Cited

U.S. PATENT DOCUMENTS

| | | | | |
|---|---|---|---|---|
| 2008/0094388 | A1* | 4/2008 | Yamazaki | 345/212 |
| 2008/0150887 | A1* | 6/2008 | Kim et al. | 345/107 |
| 2008/0238867 | A1* | 10/2008 | Maeda et al. | 345/107 |
| 2009/0128585 | A1* | 5/2009 | Shimodaira | 345/690 |
| 2009/0237350 | A1* | 9/2009 | Yamada | 345/107 |
| 2009/0237383 | A1* | 9/2009 | Saito | 345/208 |
| 2011/0102481 | A1* | 5/2011 | Miyasaka et al. | 345/690 |

FOREIGN PATENT DOCUMENTS

| | | |
|---|---|---|
| JP | 2004-102054 | 4/2004 |
| JP | 2006-267982 | 10/2006 |
| JP | 2006-526801 | 11/2006 |
| JP | 2007-041385 | 2/2007 |
| JP | 2007-316594 | 12/2007 |

* cited by examiner

METHOD OF DRIVING ELECTROPHORETIC DISPLAY DEVICE, ELECTROPHORETIC DISPLAY DEVICE, AND ELECTRONIC APPARATUS

BACKGROUND

1. Technical Field

The present invention relates to a method of driving an electrophoretic display device, an electrophoretic display device, and an electronic apparatus.

2. Related Art

In electrophoretic display devices of this type, an image is displayed by applying an electric potential difference between a pixel electrode and a common electrode that face each other with electrophoretic elements including electrophoretic particles interposed therebetween so as to move the electrophoretic particles (for example, see 2002-116733). In addition, the electrophoretic display devices of this type have a memory characteristic for conserving a displayed image even in a state that no electric potential difference is applied between the pixel electrode and the common electrode.

In addition, the electrophoretic display devices of this type can display images each having three gray scale levels or more. For example, in a case where the electrophoretic display device has the electrophoretic element including a plurality of white particles and a plurality of black particles that are charged with different charges as the electrophoretic particles, first, an electric potential difference is applied between the pixel electrodes and the common electrodes for representing a whole black display (that is, the black particles are attracted to the common electrodes of all the pixels, and the white particles are attracted to the pixel electrodes of all the pixels). Then, by applying an electric potential difference between the pixel electrode and the common electrode such that the black particles are attracted to the pixel electrode side and the white particles are attracted to the common electrode side only for a time period corresponding to the gray scale level of each pixel, a gray image can be displayed.

However, in the electrophoretic display devices of this type, when a predetermined time elapses after the image is displayed, a part of the electrophoretic particles collected in each electrode diffuses. Accordingly, for example, the reflectance of a part, which is to be displayed in a white color by the white particles, of the displayed image may decrease, and the reflectance of a part, which is to be displayed in a black color by the black particles, of the displayed image may increase. Therefore, there is a problem that the contrast of the displayed image may decrease. Accordingly, for example, in JP-A-3-213827, in order to improve the decreased contrast, technology for performing a refresh operation at each interval of 10 minutes to several tens of hours has been disclosed.

The above-described refresh operation is an operation for improving the contrast that has decreased due to diffusion of a part of the electrophoretic particles at a time when ten minutes or more elapses from display of the image. However, additionally, inventors of the invention and the like found a kickback phenomenon in which the contrast decreases in several seconds right after the image is displayed (that is, right after the image is written). Thus, for example, in the above-described case where an image having three gray scale levels or more is displayed by initially applying an electric potential difference between the pixel electrodes and the common electrodes for displaying the whole black display, and then, by applying electric potentials between the pixel electrodes and the common electrodes in accordance with the gray scale levels of the pixels, a technical problem that the contrast may decrease due to the kickback phenomenon in addition to the decrease in the contrast due to the diffusion of a part of the electrophoretic particles may occur.

SUMMARY

An advantage of some aspects of the invention is that it provides a method of driving an electrophoretic display device and an electrophoretic display device that are capable of displaying a high-quality image by improving the contrast thereof and an electronic apparatus having the electrophoretic display device.

According to a first aspect of the invention, there is provided a method of driving an electrophoretic display device having a display unit including a plurality of pixels in which electrophoretic elements each including electrophoretic particles are disposed between a pixel electrode and a common electrode that face each other. The method includes: forming a gray scale image in the display unit by applying a voltage between the pixel electrode and the common electrode of each of the plurality of pixels in accordance with image data that has three or more gray scale levels; having the pixel electrode and the common electrode in a high-impedance state to be electrically cut off only for a predetermined period after the forming of the gray scale image; applying a first pulse voltage that has a same polarity as the voltage applied in accordance with the image data having a highest gray scale level in the forming of the gray scale image between the pixel electrode and the common electrode of a pixel of the plurality of pixels to which the voltage is applied in accordance with the image data having the highest gray scale level after the having the pixel electrode and the common electrode in the high-impedance state; and applying a second pulse voltage that has a same polarity as the voltage applied in accordance with the image data having a lowest gray scale level in the forming of the gray scale image between the pixel electrode and the common electrode of a pixel of the plurality of pixels to which the voltage is applied in accordance with the image data having the lowest gray scale level after the having the pixel electrode and the common electrode in the high impedance state.

According to the above-described method of driving the electrophoretic display device, by applying a voltage between the pixel electrode and the common electrode of each pixel of the plurality of pixels included in the display unit of the electrophoretic display device, the electrophoretic particles included in the electrophoretic element disposed between the pixel electrode and the common electrode are moved between the pixel electrode and the common electrode so as to display an image in the display unit. In particular, inside the electrophoretic element that is, for example, a microcapsule, as the electrophoretic particles, for example, a plurality of white particles negatively charged and a plurality of black particles positively charged are included. According to a voltage applied between the pixel electrode and the common electrode, one group between the plurality of white particles negatively charged and the plurality of black particles positively charged is moved (that is, electrophoresis) to the pixel electrode side, and the other group is moved to the common electrode side. Thereby, an image is displayed on the common electrode side.

According to the above-described aspect of the invention, first, in the forming of the gray scale image, a gray scale image is formed in the display unit. For example, when a gray scale image having three gray scale levels including a black color, a gray color, and a white color is formed, in the forming of the gray scale image, for example, a voltage having a first polarity (that is, a voltage having a polarity for which the electric potential of the pixel electrode becomes higher than that of the common electrode) is applied first for a first predetermined period between the pixel electrodes and the common electrodes so as to represent the whole black display (that is, for the all pixels, the black particles are attracted to the common electrode and the white particles are attracted to the pixel electrode). Subsequently, for each pixel to display the gray color, a voltage having a second polarity that is opposite to the first polarity (that is, a voltage for which the electric potential of the pixel electrode is lower than that of the common electrode) is applied between the pixel electrode and the common electrode only for a second predetermined period, so that the black particles are attracted to the pixel electrode side and the white particles are attracted to the common electrode side. Subsequently, for each pixel to display the white color, a voltage having the second polarity is applied between the pixel electrode and the common electrode only for a third predetermined period that is longer than the second predetermined period. As described above, by applying voltages between the pixel electrodes and the common electrodes, for each pixel to display the black color, the black particles can be collected on the common electrode side and the white particles can be collected on the pixel electrode side, and accordingly, the black color can be displayed. On the other hand, for each pixel to display the white color, a state in which the white particles are collected on the common electrode side and the black particles are collected on the pixel electrode side can be formed, and thereby the white color can be displayed. In addition, for each pixel to display the gray color, a state in which the black particles are relatively attracted to the pixel electrode side and the white particles are relatively attracted to the common electrode side, compared to the pixel to display the black color (that is, a state that the white particles are relatively attracted to the pixel electrode side and the black particles are relatively attracted to the common electrode side, compared to the pixel to display the white color) can be formed, and thereby the gray color can be displayed. As a result, the gray scale image having three gray scale levels of the black color, the gray color, and the white color can be formed. The above-described first, second, and third predetermined periods are set in accordance with the gray scale level of the pixel data.

Subsequently, in the having of the pixel electrode and the common electrode in the high-impedance state, the pixel electrode and the common electrode are set to the high-impedance state to be electrically cut off only for a predetermined period, for example, that is equal to or longer than 200 ms and is equal to or shorter than 5 s.

According to this aspect of the invention, particularly, after the having of the pixel electrode and the common electrode in the high-impedance state, the applying of the first pulse voltage and the applying of the second pulse voltage are performed in the described order or in the order opposite to the described order.

In other words, in the applying of the first pulse voltage, between the pixel electrode and the common electrode of a pixel, to which a voltage is applied in accordance with image data of the highest gray scale level, of the plurality of pixels, a first pulse voltage having a same polarity as that of the voltage applied in accordance with the image data of the highest gray scale level in the forming of the gray scale image is applied. For example, between the pixel electrode and the common electrode of a pixel among the plurality of pixels to display the black color as the highest gray scale level, the first pulse voltage having a first polarity for which the electric potential of the pixel electrode becomes higher than that of the common electrode is applied once or a plurality of times. In addition, in the applying of the second pulse voltage, between the pixel electrode and the common electrode of a pixel, to which a voltage is applied in accordance with the image data having the lowest gray scale level, of the plurality of pixels, a second pulse voltage having a same polarity as that of the voltage applied in accordance with the image data having the lowest gray scale level in the forming of the gray scale image is applied. For example, between the pixel electrode and the common electrode of a pixel of the plurality of pixels to display the white color as the lowest gray scale level, the second pulse voltage having a second polarity for which the electric potential of the pixel electrode becomes lower than that of the common electrode is applied once or a plurality of times.

Accordingly, the contrast of the gray scale image displayed in the display unit in the forming of the gray scale image can be improved. In other words, right after the gray scale image is displayed in the forming of the gray scale image, the contrast of the gray scale image that may decrease due to the kickback phenomenon can be improved by the applying of the first and second pulse voltages. As a result, according to the method of driving the electrophoretic display device of this aspect of the invention, an image having the high quality can be displayed.

In addition, according to this aspect of the invention, particularly, the applying of the first and second pulse voltages are performed after the forming of the gray scale image is performed. Thus, the gray scale image can be displayed in a relatively short time, and accordingly, stress due to elapse of a long time until display of the image is not given or is scarcely given to an observer or a user who observes the gray scale image. In other words, after a state that most of the whole gray scale image can be recognized by an observer is formed by displaying the gray scale image in the display unit in the forming of the gray scale image, the contrast of the gray scale image can be improved by the applying of the first and second pulse voltages, and accordingly, the image having the high quality can be displayed without any stress given to the observer or with stress scarcely given to the observer.

As described above, according to the method of driving the electrophoretic display device of this aspect of the invention, the contrast can be improved, and thereby an image having the high quality can be displayed.

In the above-described method of driving the electrophoretic display device, the pixel electrode of a pixel of the plurality of pixels to which a voltage is applied in accordance with the image data having an intermediate gray scale level may be in a high-impedance state to be electrically cut off in the applying of the first pulse voltage and the applying of the second pulse voltage.

In such a case, application of an unnecessary voltage between the pixel electrode and the common electrode of a pixel to display the intermediate gray scale level that represents the gray color in a case where a gray scale image having three gray scale levels, for example, of the black color, the gray color, and the white color is formed can be prevented. In other words, adverse affect on the pixel to display the intermediate gray scale level caused by the first or second pulse voltage can be avoided.

In the above-described method of driving the electrophoretic display device, the pixel electrode and the common electrode of a pixel of the plurality of pixels to which the image data having the intermediate gray scale level is applied may be electrically synchronized with each other in the applying of the first pulse voltage and the applying of the second pulse voltage.

In such a case, the pixel electrode and the common electrode of the pixel to display the intermediate gray scale level can be set to a same electric potential. Accordingly, application of an unnecessary voltage between the pixel electrode and the common electrode of the pixel to display the intermediate gray scale level can be prevented.

In the above-described method of driving the electrophoretic display device, the electrophoretic display device may have a memory circuit including SRAMs that are electrically connected to the pixel electrodes of the plurality of pixels and can store image signals supplied to the pixel electrodes in accordance with supply of a power supplying voltage, and the first pulse voltage may be repeatedly applied a plurality of times and a power supplying voltage that is lower than the first pulse voltage is supplied to the memory circuit as the power supplying voltage in a period excluding a period in which the first pulse voltage is applied between the pixel electrode and the common electrode, in the applying of the first pulse voltage.

In such a case, in the applying of the first pulse voltage, in a period excluding a period in which the first pulse voltage is applied between the pixel electrode and the common electrode, a power supplying voltage lower than the first pulse voltage is supplied to the memory circuit including the SRAM (Static Random Access Memory) as the power supplying voltage. Accordingly, by supplying an image signal to the memory circuit once in the applying of the first pulse voltage, the image signal can be maintained to be stored in the memory circuit. Thus, supply of the image signal to the memory circuit a plurality of times in the applying of the first pulse voltage can be avoided, and thereby power consumption needed for supplying the image signal to each pixel can be reduced. The power consumption needed for supplying an image signal to each pixel is larger than power consumption needed for supplying the power supplying voltage that is lower than the first pulse voltage to the memory circuit.

In the above-described method of driving the electrophoretic display device, the electrophoretic display device may be configured to have a memory circuit including SRAMs that are electrically connected to the pixel electrodes of the plurality of pixels and can store image signals supplied to the pixel electrodes in accordance with supply of a power supplying voltage, and the second pulse voltage may be repeatedly applied a plurality of times and a voltage that is lower than the second pulse voltage is supplied to the memory circuit as the power supplying voltage in a period excluding a period in which the second pulse voltage is applied between the pixel electrode and the common electrode, in the applying of the second pulse voltage.

In such a case, in the applying of the second pulse voltage, in a period excluding a period in which the second pulse voltage is applied between the pixel electrode and the common electrode, a power supplying voltage lower than the second pulse voltage is supplied to the memory circuit including the SRAM as the power supplying voltage. Accordingly, by supplying an image signal to the memory circuit once in the applying of the second pulse voltage, the image signal can be maintained to be stored in the memory circuit. Thus, supply of the image signal to the memory circuit a plurality of times in the applying of the second pulse voltage can be avoided, and thereby power consumption needed for supplying the image signal to each pixel can be reduced. The power consumption needed for supplying an image signal to each pixel is larger than power consumption needed for supplying the power supplying voltage that is lower than the second pulse voltage to the memory circuit.

According to a second aspect of the invention, there is provided an electrophoretic display device that is driven by the above-described method (including the various forms).

According to the above-described electrophoretic display device, the electrophoretic display device is driven by using the above-described method of driving the electrophoretic display device, a high-contrast image having the high quality can be displayed.

According to a third aspect of the invention, there is provided an electronic apparatus including the above-described electrophoretic display device (including the various forms).

According to the above-described electronic apparatus, the above-described electrophoretic display device is included. Therefore, various electronic apparatuses such as a wrist watch, an electronic paper sheet, an electronic notebook, a cellular phone, and a mobile audio instrument capable of displaying a high contrast image having the high quality can be implemented.

The operation and other advantages of the invention will be disclosed in the following description of exemplary embodiments.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

First Embodiment

An electrophoretic display device according to a first embodiment of the invention will now be described with reference to FIGS. 1 to 10.

First, the whole configuration of the electrophoretic display device according to this embodiment will be described with reference to FIGS. 1 and 2.

Figure 1:
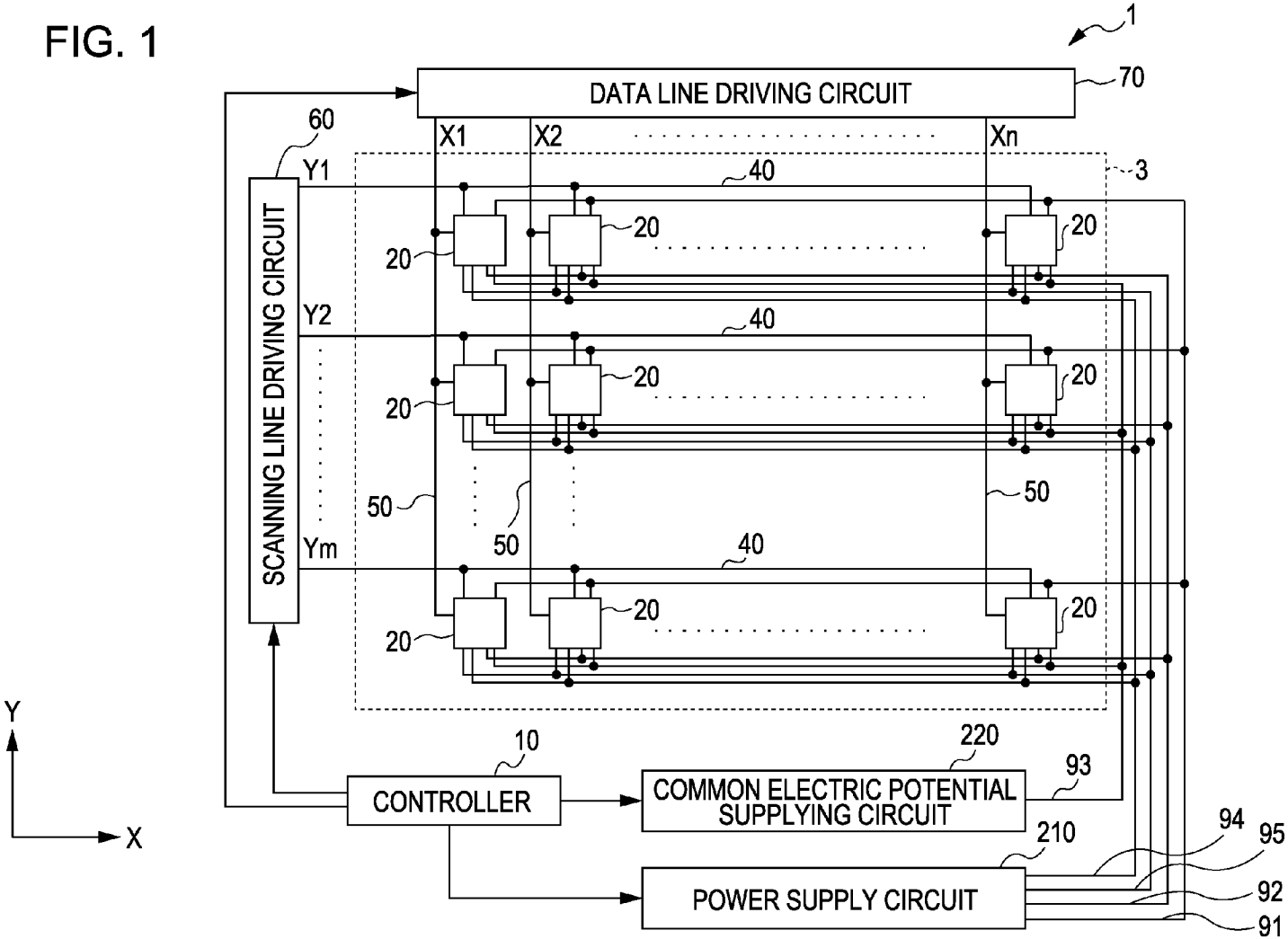
FIG. 1 is a block diagram showing the whole configuration of an electrophoretic display device according to a first embodiment of the invention.

FIG. 1 is a block diagram showing the whole configuration of the electrophoretic display device according to this embodiment.

As shown in FIG. 1, the electrophoretic display device 1 according to this embodiment includes a display unit 3, a controller 10, a scanning line driving circuit 60, a data line driving circuit 70, a power supply circuit 210, and a common electric potential supplying circuit 220.

In the display unit 3, pixels 20 of m rows×n columns are arranged in a matrix shape (in a two-dimensional plane). In addition, in the display unit 3, m scanning lines 40 (that is, scanning lines Y1, Y2, . . . , Ym) and n data lines 50 (that is, data lines X1, X2, . . . , Xn) are disposed to intersect each other. In particular, m scanning lines 40 extend in the row direction (that is, direction X), and n data lines 50 extend in the column direction (that is, direction Y). In addition, the pixels 20 are disposed in correspondence with intersections of the m scanning lines 40 and the n data lines 50.

The controller 10 controls operations of the scanning line driving circuit 60, the data line driving circuit 70, the power supply circuit 210, and the common electric potential supplying circuit 220. The controller 10, for example, supplies timing signals such as a clock signal and a start pulse to each circuit.

The scanning line driving circuit 60 sequentially supplies scanning signals in pulses to the scanning lines Y1, Y2, . . . , Ym based on a timing signal that is supplied from the controller 10.

The data line driving circuit 70 supplies image signals to the data lines X1, X2, . . . , Xn based on a timing signal that is supplied from the controller 10. The image signals have binary levels including a high electric potential level (hereinafter, referred to as a "high level", for example, 5 V) and a low electric potential level (hereinafter, referred to as a low level, for example, 0 V).

The power supply circuit 210 supplies a high power supplying electric potential VEP to a high-electric potential power line 91, supplies a low power supplying electric potential Vss to a low-electric potential power line 92, supplies a first electric potential S1 to a first control line 94, and supplies a second electric potential S2 to a second control line 95. Although not shown in the figure, the high-electric potential power line 91, the low-electric potential power line 92, the first control line 94, and the second control line 95 are electrically connected to the power supply circuit 210 through electrical switches.

The common electric potential supplying circuit 220 supplies a common electric potential Vcom to a common electric potential line 93. Although not shown in the figure, the common electric potential line 93 is electrically connected to the common electric potential supplying circuit 220 through an electrical switch.

In addition, various signals are input to or output from the controller 10, the scanning line driving circuit 60, the data line driving circuit 70, the power supply circuit 210, and the common electric potential supplying circuit 220. However, a description for transmission of signals that is not directly related to this embodiment is omitted here.

Figure 2:
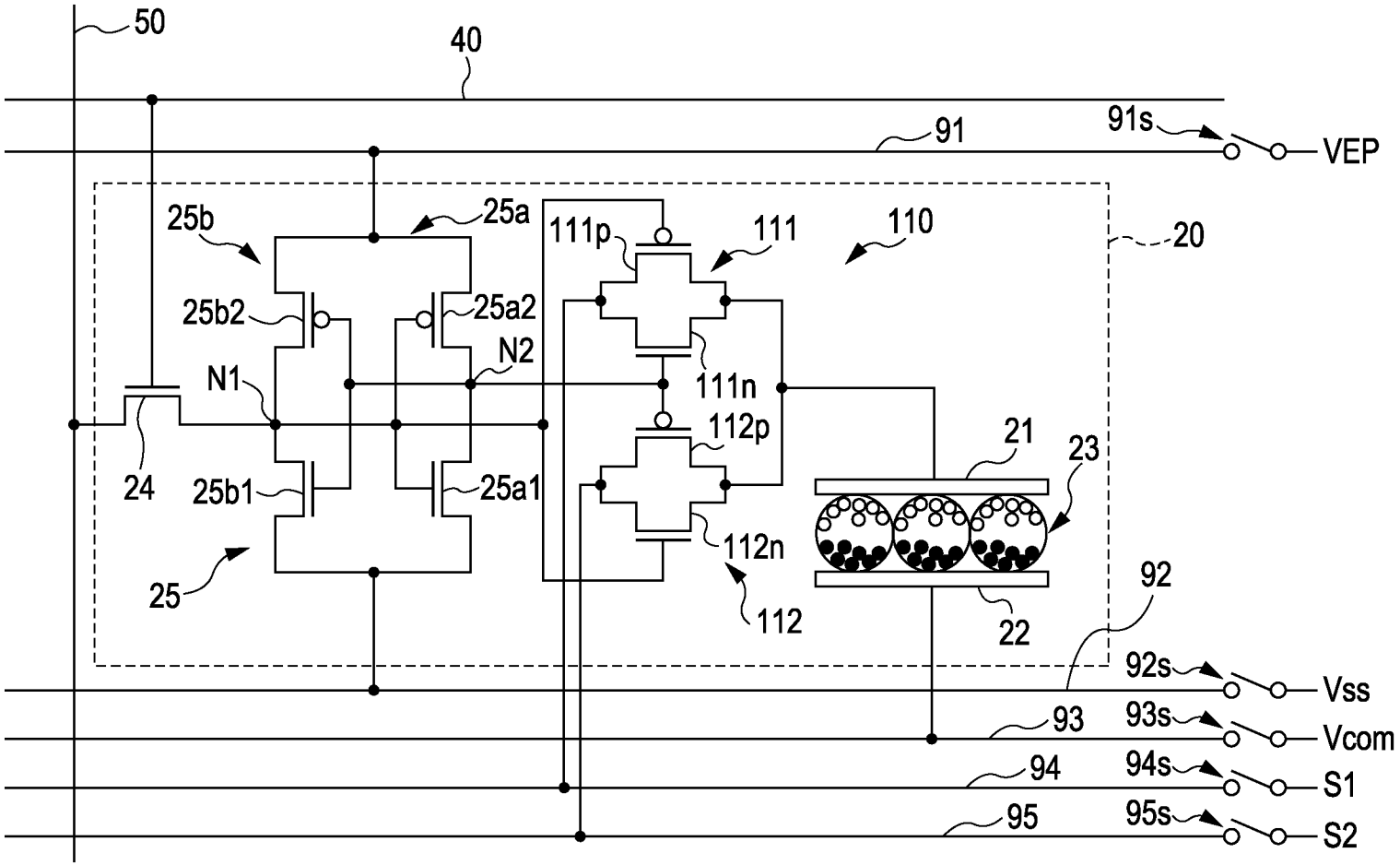
FIG. 2 is an equivalent circuit diagram showing the electrical configuration of a pixel of the electrophoretic display device according to the first embodiment.

FIG. 2 is an equivalent circuit diagram showing the electrical configuration of a pixel.

As shown in FIG. 2, the pixel 20 includes a pixel switching transistor 24, a memory circuit 25, a switching circuit 110, a pixel electrode 21, a common electrode 22, and an electrophoretic element 23.

The pixel switching transistor 24 is configured by an N-type transistor. The gate of the pixel switching transistor 24 is electrically connected to the scanning line 40, the source of the pixel switching transistor is electrically connected to the data line 50, and the drain of the pixel switching transistor is electrically connected to an input terminal N1 of the memory circuit 25. The pixel switching transistor 24 outputs an image signal that is supplied from the data line driving circuit 70 (see FIG. 1) through the data line 50 to the input terminal N1 of the memory circuit 25 at a timing corresponding to the scanning signal that is supplied as a pulse from the scanning line driving circuit 60 (see FIG. 1) through the scanning line 40.

The memory circuit 25 includes inverter circuits 25*a* and 25*b* and is configured by an SRAM.

The inverter circuits 25*a* and 25*b* form a loop structure in which, to an input terminal of any one between the inverter circuits, an output terminal of the other is connected. In other words, the input terminal of the inverter circuit 25*a* and the output terminal of the inverter circuit 25*b* are electrically connected together, and the input terminal of the inverter circuit 25*b* and the output terminal of the inverter circuit 25*a* are electrically connected together. In addition, the input terminal of the inverter circuit 25*a* is configured as the input terminal N1 of the memory circuit 25, and the output terminal of the inverter circuit 25*a* is configured as an output terminal N2 of the memory circuit 25.

The inverter circuit 25*a* has an N-type transistor 25*a*1 and a P-type transistor 25*a*2. The gates of the N-type transistor 25*a*1 and the P-type transistor 25*a*2 are electrically connected to the input terminal N1 of the memory circuit 25. The source of the N-type transistor 25*a*1 is electrically connected to the low electric potential power line 92 to which the low power supplying electric potential Vss is supplied. In addition, the source of the P-type transistor 25*a*2 is electrically connected to the high potential power line 91 to which the high power supplying electric potential VEP is supplied. The drains of the N-type transistor 25*a*1 and the P-type transistor 25*a*2 are electrically connected to the output terminal N2 of the memory circuit 25.

The inverter circuit 25*b* has an N-type transistor 25*b*1 and a P-type transistor 25*b*2. The gates of the N-type transistor 25*b*1 and the P-type transistor 25*b*2 are electrically connected to the output terminal N2 of the memory circuit 25. The source of the N-type transistor 25*b*1 is electrically connected to the low electric potential power line 92 to which the low power supplying electric potential Vss is supplied. In addition, the source of the P-type transistor 25*b*2 is electrically connected to the high potential power line 91 to which the high power supplying electric potential VEP is supplied. The drains of the N-type transistor 25*b*1 and the P-type transistor 25*b*2 are electrically connected to the input terminal N1 of the memory circuit 25.

The memory circuit 25 outputs the low power supplying electric potential Vss from the output terminal N2 in a case where a high-level image signal is input to the input terminal N1 and outputs the high power supplying electric potential VEP from the output terminal N2 in a case where a low-level image signal is input to the input terminal N1. In other words, the memory circuit 25 outputs the low power supplying electric potential Vss or the high power supplying electric potential VEP depending on whether the input image signal is the high level or the low level. It may be paraphrased that the memory circuit 25 is configured to be able to store the input image signal as the low power supplying electric potential Vss or the high power supplying electric potential VEP.

The high electric potential power line 91 and the low electric potential power line 92 are configured to be supplied with the high power supplying electric potential VEP and the low power supplying electric potential Vss from the power supply circuit 210. The high electric potential power line 91 is electrically connected to the power supply circuit 210 through a switch 91*s*, and the low electric potential power line 92 is electrically connected to the power supply circuit 210 through a switch 92*s*. The switches 91*s* and 92*s* are configured to be switched between the ON state and the OFF state by the controller 10. As the switch 91*s* is in the ON state, the high electric potential power line 91 and the power supply circuit 210 are electrically connected together. On the other hand, as the switch 91*s* is in the OFF state, the high electric potential power line 91 is in a high-impedance state to be electrically cut off. In addition, as the switch 92*s* is in the ON state, the low electric potential power line 92 and the power supply circuit 210 are electrically connected together. On the other hand, as the switch 92*s* is in the OFF state, the low electric potential power line 92 is in the high-impedance state to be electrically cut off.

The switching circuit 110 includes a first transmission gate 111 and a second transmission gate 112.

The first transmission gate 111 has a P-type transistor 111*p* and an N-type transistor 111*n*. The sources of the P-type transistor 111*p* and the N-type transistor 111*n* are electrically connected to the first control line 94. In addition, the drains of the P-type transistor 111*p* and the N-type transistor 111*n* are electrically connected to a pixel electrode 21. The gate of the P-type transistor 111*p* is electrically connected to the input terminal N1 of the memory circuit 25, and the gate of the N-type transistor 111*n* is electrically connected to the output terminal N2 of the memory circuit 25.

The second transmission gate 112 has a P-type transistor 112*p* and an N-type transistor 112*n*. The sources of the P-type transistor 112*p* and the N-type transistor 112*n* are electrically connected to the second control line 95. In addition, the drains of the P-type transistor 112*p* and the N-type transistor 112*n* are electrically connected to the pixel electrode 21. The gate of the P-type transistor 112*p* is electrically connected to the output terminal N2 of the memory circuit 25, and the gate of the N-type transistor 112*n* is electrically connected to the input terminal N1 of the memory circuit 25.

The switching circuit 110 alternately selects any one control line between the first control line 94 and the second control line 95 in accordance with an image signal input to the memory circuit 25 and electrically connects the one control line to the pixel electrode 21.

In particular, when an image signal having a high level is input to the input terminal N1 of the memory circuit 25, the low power supplying electric potential Vss is output from the memory circuit 25 to the gates of the N-type transistor 111*n* and the P-type transistor 112*p*, and the high power supplying electric potential VEP is output to the gates of the P-type transistor 111*p* and the N-type transistor 112*n*. Accordingly, in such a case, only the P-type transistor 112*p* and the N-type transistor 112*n* that constitute the second transmission gate 112 are in the ON state, and the P-type transistor 111*p* and the N-type transistor 111*n* that constitute the first transmission gate 111 are in the OFF state. On the other hand, when an image signal having a low level is input to the input terminal N1 of the memory circuit 25, the high power supplying electric potential VEP is output from the memory circuit 25 to the gates of the N-type transistor 111*n* and the P-type transistor 112*p*, and the low power supplying electric potential Vss is output to the gates of the P-type transistor 111*p* and the N-type transistor 112*n*. Accordingly, in such a case, only the P-type transistor 111*p* and the N-type transistor 111*n* that constitute the first transmission gate 111 are in the ON state, and the P-type transistor 112*p* and the N-type transistor 112*n* that constitute the second transmission gate 112 are in the OFF state. In other words, when an image signal having the high level is input to the input terminal N1 of the memory circuit 25, only the second transmission gate 112 is in the ON state. On the other hand, when an image signal having the low level is input to the input terminal N1 of the memory circuit 25, only the first transmission gate 111 is in the ON state.

The first control line 94 and the second control line 95 are configured to be supplied with the first electric potential S1 and the second electric potential S2 from the power supply circuit 210. The first control line 94 is electrically connected to the power supply circuit 210 through a switch 94*s*, and the second control line 95 is electrically connected to the power supply circuit 210 through a switch 95*s*. The switches 94*s* and 95*s* are configured to be switched between the ON state and the OFF state by the controller 10. As the switch 94*s* is in the ON state, the first control line 94 and the power supply circuit 210 are electrically connected together. In addition, as the switch 94*s* is in the OFF state, the first control line 94 is in the high-impedance state to be electrically cut off. As the switch 95*s* is in the ON state, the second control line 95 and the power supply circuit 210 are electrically connected together. In addition, as the switch 95*s* is in the OFF state, the second control line 95 is in the high-impedance state to be electrically cut off.

A pixel electrode 21 of each of the plurality of the pixels 20 is electrically connected to the control line 94 or 95 that is alternately selected in accordance with the image signal by the switching circuit 110. In such a case, the pixel electrode 21 of each of the plurality of the pixels 20 is supplied with the first electric potential S1 or the second electric potential S2 from the power supply circuit 210 based on the ON state or OFF state of the switch 94*s* or 95*s* or is in the high-impedance state.

In particular, in the pixel 20 to which the image signal having the low level is supplied, only the first transmission gate 111 is in the ON state. Accordingly, the pixel electrode 21 of the pixel 20 is electrically connected to the first control line 94 and is supplied with the first electric potential S1 from the power supply circuit 210 or is in the high-impedance state in accordance with the ON state or the OFF state of the switch 94*s*. On the other hand, in the pixel 20 to which the image signal having the high level is supplied, only the second transmission gate 112 is in the ON state. Accordingly, the pixel electrode 21 of the pixel 20 is electrically connected to the second control line 95 and is supplied with the second electric potential S2 from the power supply circuit 210 or is in the high-impedance state in accordance with the ON or OFF state of the switch 95*s*.

The pixel electrode 21 is disposed to face the common electrode 22 through the electrophoretic element 23.

The common electrode 22 is electrically connected to the common electric potential line 93 to which the common electric potential Vcom is supplied. The common electric potential line 93 is configured to be able to be supplied with the common electric potential Vcom from the common electric potential supplying circuit 220. The common electric potential line 93 is electrically connected to the common electric potential supplying circuit 220 through a switch 93*s*. The switch 93*s* is configured to be switched between the ON state and the OFF state by the controller 10. As the switch 93*s* is in the ON state, the common electric potential supplying circuit 220 is electrically connected to the common electric potential line 93. In addition, as the switch 93*s* is in the OFF state, the common electric potential line 93 is in the high-impedance state to be electrically cut off.

The electrophoretic element 23 is configured by a plurality of microcapsules that is formed to include electrophoretic particles.

Next, a detailed configuration of the display unit of the electrophoretic display device according to this embodiment will be described with reference to FIGS. 3 and 4.

Figure 3:
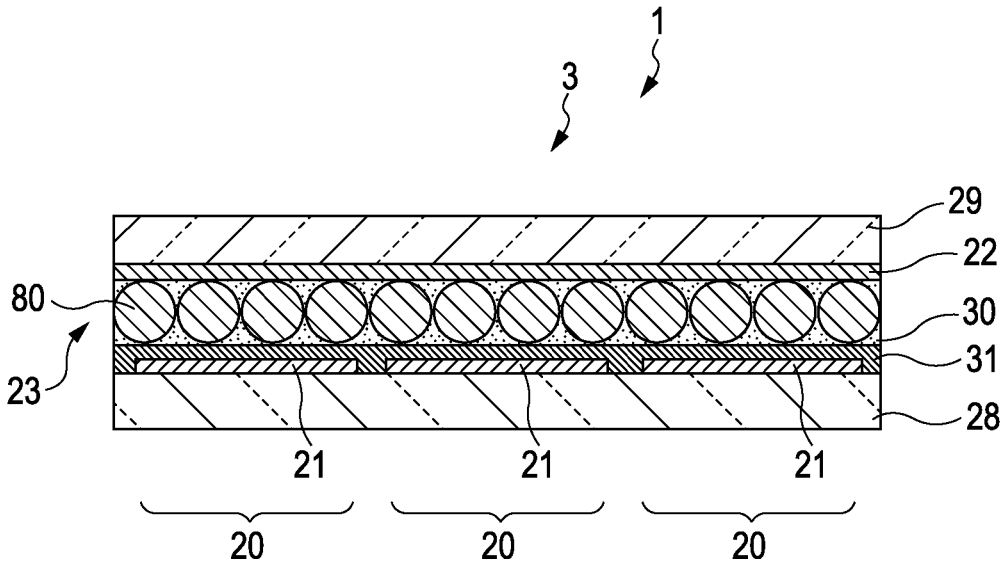
FIG. 3 is a partial cross-section view of a display unit of the electrophoretic display device according to the first embodiment.

FIG. 3 is a partial cross-section view of the display unit of the electrophoretic display device according to this embodiment.

As shown in FIG. 3, the display unit 3 has a configuration in which the electrophoretic element 23 is pinched between a component substrate 28 and an opposing substrate 29. In this embodiment, descriptions will be made on a premise that an image is displayed on the opposing substrate 29 side.

The component substrate 28 is a substrate that is formed of glass, plastic, or the like. On the component substrate 28, although not shown in the figure, a lamination structure in which the pixel switching transistor 24, the memory circuit 25, the switching circuit 110, the scanning lines 40, the data lines 50, the high-potential power line 91, the low-potential power line 92, the common electric potential line 93, the first control line 94, the second control line 95, and the like that have been described above with reference to FIG. 2 are formed is formed. On the upper-layer side of the lamination structure, a plurality of the pixel electrodes 21 is disposed in a matrix shape.

The opposing substrate 29 is a transparent substrate, for example, formed of glass, plastic, or the like. On a face of the opposing substrate 29 which faces the component substrate 28, the common electrode 22 is formed on the entire face so as to face a plurality of pixel electrodes 9*a*. The common electrode 22 is formed of a transparent conduction material such as magnesium silver (MgAg), indium tin oxide (ITO), or indium zinc oxide (IZO).

The electrophoretic element 23 is configured by a plurality of the microcapsules 80 that is formed to include electrophoretic particles. The electrophoretic element 23 is fixed between the component substrate 28 and the opposing substrate 29 by a binder 30, for example, formed of a resin or the like and an adhesive layer 31. In the electrophoretic display device 1 according to this embodiment, in the manufacturing process, an electrophoretic sheet in which the electrophoretic element 23 is fixed to the opposing substrate 29 side by a binder 30 in advance is bonded to a side of the separately-produced component substrate 28 on which the pixel electrode 21 and the like are formed through the adhesive layer 31.

The microcapsule 80 is pinched by the pixel electrode 21 and the common electrode 22. One or a plurality of the microcapsules is disposed within one pixel 20 (that is, for one pixel electrode 21).

Figure 4:
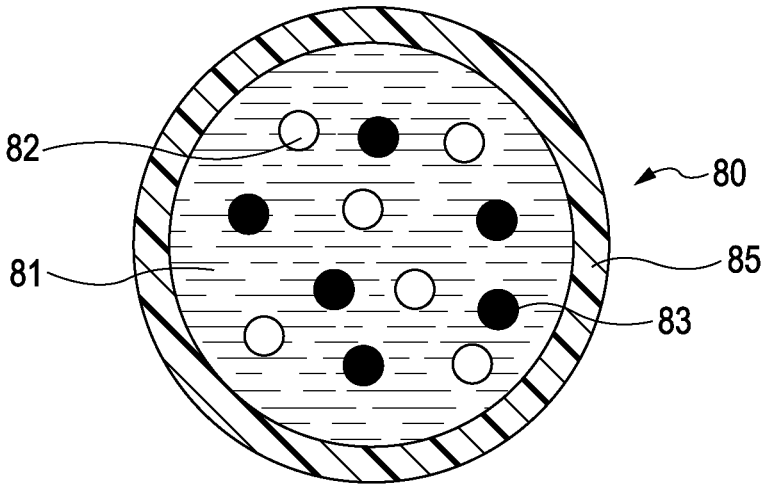
FIG. 4 is a schematic diagram showing the configuration of a microcapsule.

FIG. 4 is a schematic diagram showing the configuration of the microcapsule. In FIG. 4, the cross-section of the microcapsule is shown.

As shown in FIG. 4, inside a coating film 85 of the microcapsule 80, a dispersion medium 81, a plurality of white particles 82, and a plurality of black particles 83 are 83 are enclosed. The microcapsule 80, for example, is formed in a sphere shape having a particle diameter of about 50 μm. The white particles 82 and the black particles 83 are examples of the "electrophoretic element" according to an embodiment of the invention.

The coating film 85 serves as an outer shell of the microcapsule 80 and is formed of high-molecular resin such as acryl resin including polymethylmethacrylate, polyethylmethacrylate, or the like, urea resin, gum Arabic, or the like that has transparency.

The dispersion medium 81 is a medium that disperses the white particles 82 and the black particles 83 into the inside of the microcapsule 80 (that is, the inside of the coating film 85). As the dispersion medium 81, water; an alcohol-based solvent such as methanol, ethanol, isopropanol, butanol, octanol, or methyl cellosolve; a variety of esters such as acetic ethyl or acetic butyl; ketone such as acetone, methylethylketone, or methylisobutylketone; aliphatic hydrocarbon such as pentane, hexane, or octane; cycloaliphatic hydrocarbon such as cyclohexane or methylcyclohexane; aromatic hydrocarbon such as benzene, toluene, or benzene having a long-chain alkyl group including xylene, hexylbenzene, hebuthylbenzene, octylbenzene, nonylbenzene, decylbenzene, undecylbenzene, dodecylbenzene, tridecylebenzene, or tetradecylbenzene; halogenated hydrocarbon such as methylene chloride, chloroform, carbon tetrachloride, or 1,2-dichloroethane; carboxylate; or other kinds of oils can be used in the form of a single material or a mixture. In addition, surfactant may be added to the above-described dispersion medium 81.

The white particles 82 are particles (polymer particles or colloids) made of white pigment such as titanium dioxide, zinc flower (zinc oxide), or antimony trioxide and, for example, are charged negatively.

The black particles 83 are particles (polymer particles or colloids) made of black pigment such as aniline black or carbon black and, for example, are charged positively.

Accordingly, the white particles 82 and the black particles 83 can move in the dispersion medium 81 due to an electric field that is generated by an electric potential difference between the pixel electrode 21 and the common electrode 22.

In addition, a charge control agent containing particles of an electrolyte, a surfactant, metal soap, a resin, rubber, oil, varnish, compound, or the like; a dispersant such as a titanium-coupling agent, an aluminum-coupling agent, and a silane-coupling agent; a lubricant; a stabilizing agent; or the like may be added to the above-described pigment, as is needed.

In FIGS. 3 and 4, when a voltage is applied between the pixel electrode 21 and the common electrode 22 such that the electric potential of the common electrode 22 is high relative to the pixel electrode, the positively charged black particles 83 are attracted to the pixel electrode 21 side within the microcapsule 80 by the coulomb force, and the negatively charged white particles 82 are attracted to the common electrode 22 side within the microcapsule 80 by the coulomb force. As a result, the white particles 82 are collected on the display face side (that is, the common electrode 22 side) of the microcapsule 80, and thereby the color (that is, the white color) of the white particles 82 can be displayed on the display face of the display unit 3. To the contrary, when a voltage is applied between the pixel electrode 21 and the common electrode 22 such that the electric potential of the pixel electrode 21 is high relative to the common electrode, the negatively charged white particles 82 are attracted to the pixel electrode 21 side by the coulomb force, and the positively charged black particles 83 are attracted to the common electrode 22 side by the coulomb force. As a result, the black particles 83 are collected on the display face side of the microcapsule 80, and thereby the color (that is, the black color) of the black particles 83 can be displayed on the display face of the display unit 3.

In addition, by changing the state of the distribution of the white particles 82 and the black particles 83 between the pixel electrode 21 and the common electrode 22, a gray color such as a light gray color, a gray color, or a dark gray color that corresponds to an intermediate gray scale level between the white color and the black color can be displayed. For example, after the black particles 83 are collected on the display face side of the microcapsule 80 and the white particles 82 are collected on the pixel electrode 21 side by applying a voltage between the pixel electrode 21 and the common electrode 22 such that the electric potential of the pixel electrode 21 becomes high relative to that of the common electrode, a voltage is applied between the pixel electrode 21 and the common electrode 22 such that the electric potential of the common electrode 22 becomes high relative to that of the pixel electrode 22 only for a predetermined period corresponding to an intermediate gray scale level to be represented, and thereby a predetermined amount of the white particles 82 are moved to the display face side of the microcapsule 80 and a predetermined amount of the black particles 83 are moved to the pixel electrode 21 side. As a result, a gray color that corresponds to an intermediate gray scale level between the white color and the black color can be displayed on the display face of the display unit 3.

In addition, by using pigment, for example, of a red color, a green color, a blue color, or the like instead of the pigment used for the white particles 82 or the black particles 83, the red color, the green color, the blue color, or the like can be displayed.

Next, a method of driving the electrophoretic display device according to this embodiment will be described with reference to FIGS. 5 to 10.

Figure 5:
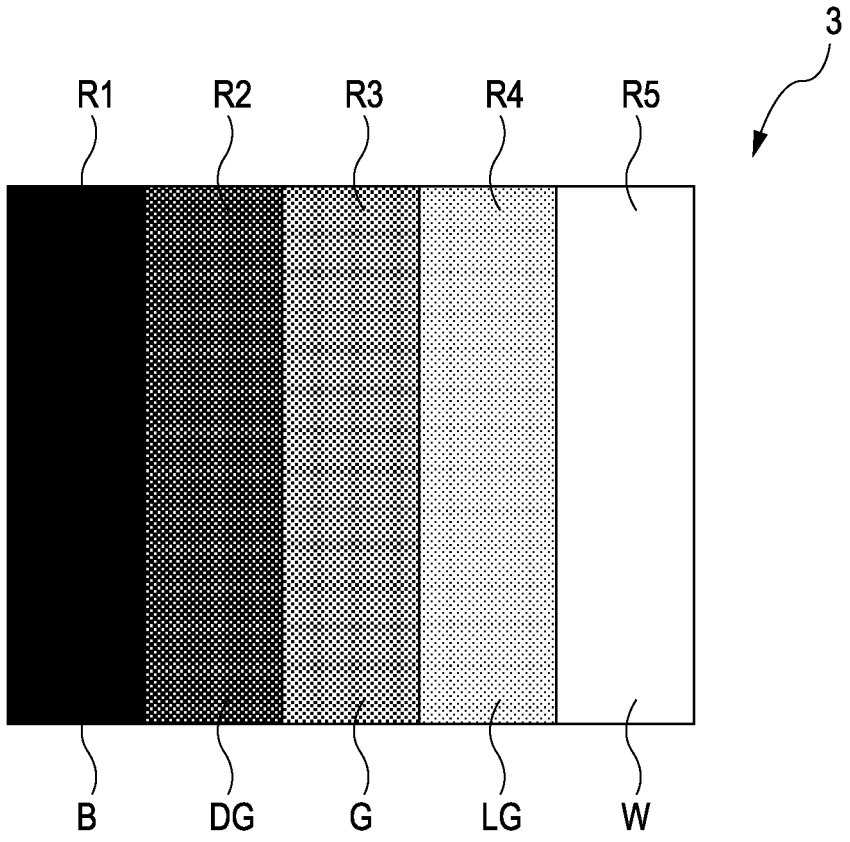
FIG. 5 is a schematic diagram showing a display unit of the electrophoretic display device in a state that an example of a gray scale image is displayed.

Hereinafter, for the convenience of description, a case where an image having five gray scale levels as shown in FIG. 5 is displayed in the display unit 3 of the electrophoretic display device 1 by using the method of driving the electrophoretic display device according to this embodiment will be exemplified. FIG. 5 is a schematic diagram showing the display unit of the electrophoretic display device in a state that an example of a gray scale image is displayed.

As shown in FIG. 5, a case where a gray scale image having five levels of a black color, a dark gray color, a gray color, a light gray color, and a white color is displayed in the display unit 3 by displaying a black color B in a part R1 of the display unit 3, displaying a dark gray color DG in a part R2 of the display unit 3, displaying a gray color G in a part R3 of the display unit 3, displaying a light gray color LG in a part R4 of the display unit 3, and displaying a white color W in a part R5 of the display unit 3 is exemplified. The black color and the white color are examples of "the highest gray scale level" and "the lowest gray scale level" in this embodiment.

Figure 6:
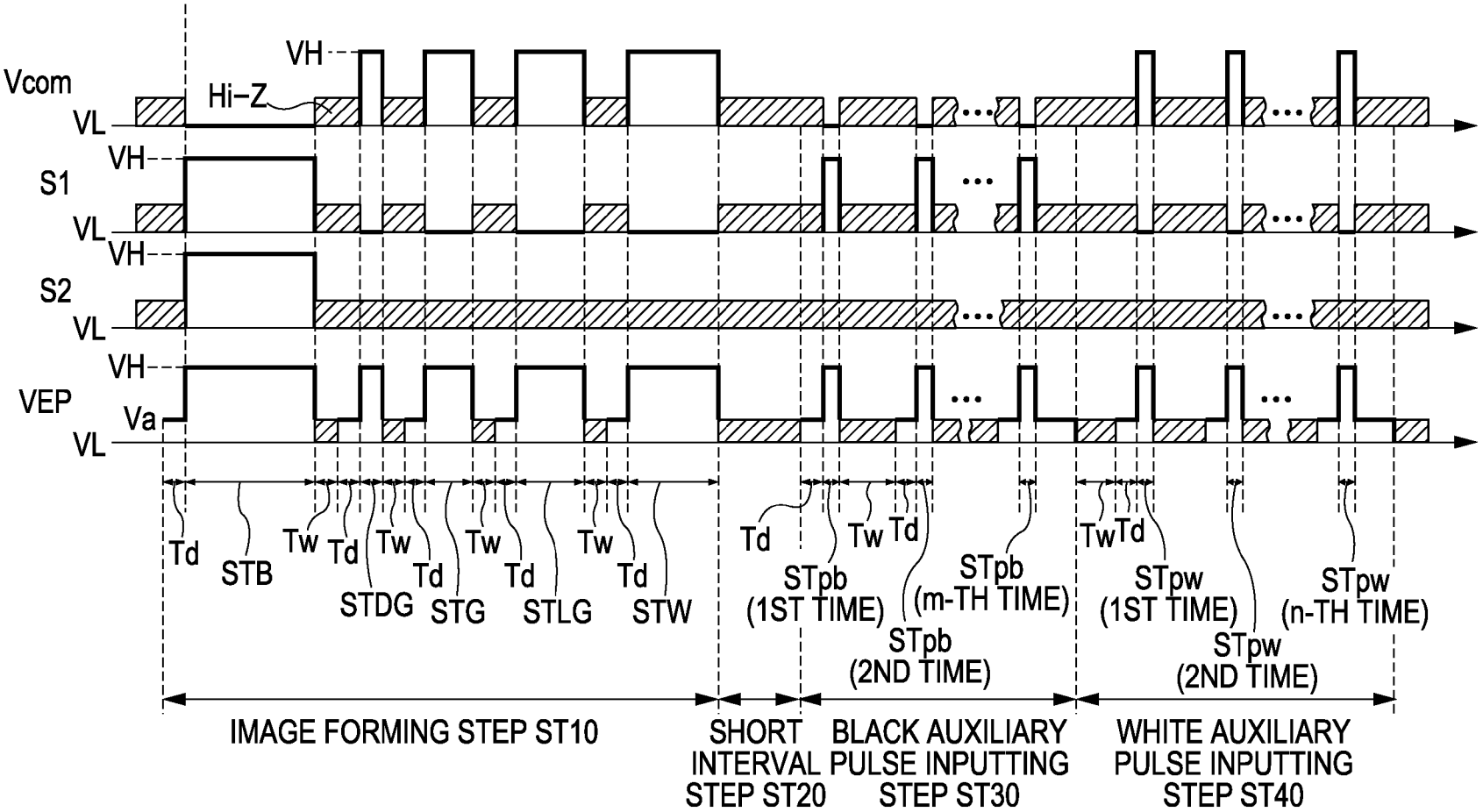
FIG. 6 is a timing chart showing a method of driving the electrophoretic display device according to the first embodiment.

FIG. 6 is a timing chart showing the method of driving the electrophoretic display device according to this embodiment. FIG. 6 shows temporal changes of the common electric potential Vcom, the first electric potential S1, the second electric potential S2, and the high power supplying electric potential VEP. The low-potential power supplying electric potential Vss is fixed to the low electric potential VL (for example, 0 V).

As shown in FIG. 6, in the method of driving the electrophoretic display device according to this embodiment, an image forming step ST10, a short interval step ST20, a black auxiliary pulse inputting step ST30, and a white auxiliary pulse inputting step ST40 are performed in the described order. The black auxiliary pulse inputting step ST30 and the white auxiliary pulse inputting step ST40 may be performed in the opposite order. In other words, the white auxiliary pulse inputting step ST40 may be performed before the black auxiliary pulse inputting step ST30 is performed.

As shown in FIG. 6, the image forming step ST10 includes a black color writing step STB, a dark gray color writing step STDG, a gray color writing step STG, a light gray color writing step STLG, and a white color writing step STW.

Figure 7:
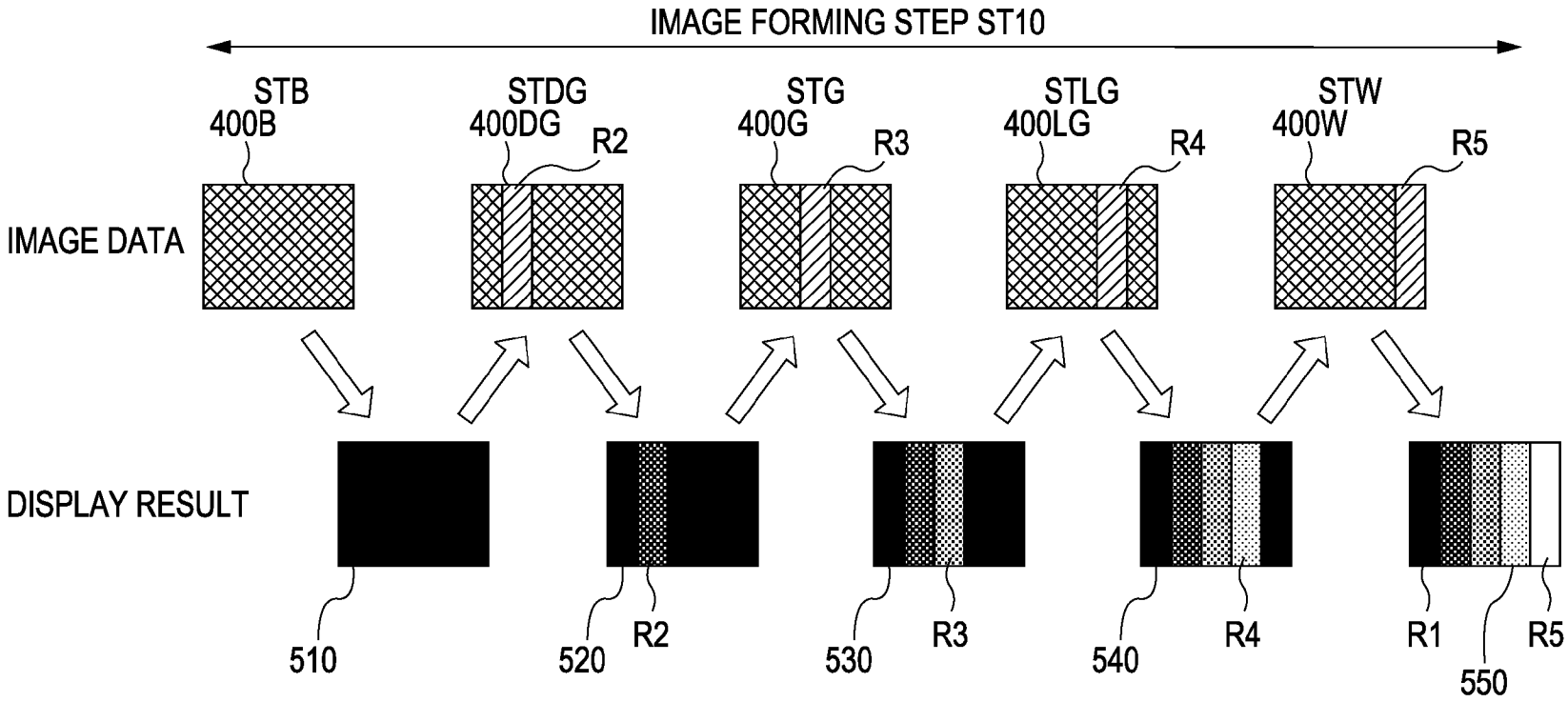
FIG. 7 is a schematic diagram showing image data and display results of a black color writing step, a dark gray color writing step, a gray color writing step, a light gray color writing step, and a white color writing step.

FIG. 7 is a schematic diagram showing image data and display results of the black color writing step, the dark gray color writing step, the gray color writing step, the light gray color writing step, and the white color writing step.

As shown in FIGS. 6 and 7, in the image forming step ST10, first, the black color writing step STB is performed. In the black color writing step STB, voltages are applied between the pixel electrodes 21 and the common electrodes 22 of all the pixels 20 of the display unit 3 such that the electric potentials of the pixel electrodes 21 become high relative to that of the common electrodes 22. In particular, for all the pixels 20, by supplying image signals having a high level, only the second transmission gates 112 (see FIG. 2) are in the ON state, and by electrically connecting the pixel electrodes 21 to the second control line 95, the second electric potential S2 is supplied to the pixel electrodes 21. The image data 400B shown in FIG. 7 conceptually represents supply of the second electric potential S2 to all the pixels 20 in the black color writing step STB. At that moment, the second electric potential S2 is maintained at the high potential VH (for example, 15 V) by the power supply circuit 210, and the common electric potential Vcom is maintained at the low electric potential VL (for example, 0 V) by the common electric potential supplying circuit 220. In addition, in the block color writing step STB, the high power supplying electric potential VEP is maintained at the high electric potential VH by the power supply circuit 210, and the first electric potential S1 is maintained at the high electric potential VH by the power supply circuit 210.

As a result, after the black color writing step STB, the black color is displayed in all the pixels 20 of the display unit 3, and thereby a whole black image 510 (see FIG. 7) is displayed in the display unit 3. In the black color writing step STB, by maintaining the first electric potential S1, as the second electric potential S2, at the high electric potential VH, the black color can be displayed in all the pixels 20 regardless of the image signals supplied to the pixels 20.

As shown in FIGS. 6 and 7, after the black color writing step STB, the dark gray color writing step STDG is performed. However, as shown in FIG. 6, right prior to the dark gray color writing step STDG, an image data generating period Tw and an image data transmitting period Td are arranged. The image data writing period Tw is a period for generating image data, and the image data transmitting period Td is a period (in particular, a period for supplying an image signal on the basis of the image data to the memory circuit 25 of each pixel) for transmitting the image data to each pixel 20. The image data generating period Tw and the image data transmitting period Td are also arranged right prior to the gray color writing step STG, the light gray color writing step STLG, the white color writing step STW, a black auxiliary pulse writing step STpb, and a white auxiliary pulse writing step STpw that will be described below.

As shown in FIG. 6, in the image data generating period Tw, the common electric potential Vcom, the first electric potential S1, the second electric potential S2, and the high electric-potential power supplying electric potential VEP are in the high-impedance state (Hi-Z). In other words, in the image data generating period Tw, the switches 93*s*, 94*s*, 95*s*, and 91*s*, which have been described with reference to FIG. 2, are in the OFF state. Thus, as the common electric potential line 93, the first control line 94, the second control line 95, and the high-electric potential power line 91 are in the high impedance state, the pixel electrode 21 and the common electrode 22 are in the high impedance state.

As shown in FIG. 6, in the image data transmitting period Td, the common electric potential Vcom, the first electric potential S1, and the second electric potential S2 are in the high impedance state, and the high power supplying electric potential VEP is maintained at an electric potential Va that is lower than the high electric potential VH and is higher than the low electric potential VL. For example, when the high electric potential VH is 15 V, the electric potential Va is set to 5 V. Here, it is preferable that the electric potential Va is set to a lowest electric potential (voltage) at which the memory circuit 25 can memorize and maintain the image data for reducing the power consumption.

As shown in FIGS. 6 and 7, in the dark gray color writing step STDG, between the pixel electrodes 21 and the common electrodes 22 of the pixels 20 that are disposed in the part R2 of the display unit 3, a voltage is applied such that the electric potentials of the common electrodes 22 become high relative to those of the pixel electrodes, and no voltage is applied between the pixel electrodes 21 and the common electrodes 22 of the pixels 20 that are disposed in the parts R1, R3, R4, and R5 of the display unit 3.

In particular, by supplying image signals having a low level to the pixels 20 disposed in the part R2, only the first transmission gates 111 (see FIG. 2) are in the ON state. Accordingly, in the pixels disposed in the part R2, the pixel electrodes 21 are electrically connected to the first control line 94, and thus, the first electric potential S1 is supplied to the pixel electrodes 21. In addition, by supplying image signals having a high level to the pixels 20 that are disposed in the parts R1, R3, R4, and R5, only the second transmission gates 112 (see FIG. 2) are in the ON state. Accordingly, in the pixels disposed in the parts R1, R3, R4, and R5, the pixel electrodes 21 are electrically connected to the second control line 95, and thus, the second electric potential S2 is supplied to the pixel electrodes 21. The image data 400DG shown in FIG. 7 conceptually represents that the first electric potential S1 is supplied to the pixels 20 disposed in the part R2 and the second electric potential S2 is supplied to the pixels 20 disposed in the parts R1, R3, R4, and R5. At that moment, the first electric potential S1 is maintained at the low electric potential VL by the power supply circuit 210, and the common electric potential Vcom is maintained at the high electric potential VH by the common electric potential supplying circuit 220. In addition, in the dark gray color writing step STDG, the high power supplying electric potential VEP is maintained at the high electric potential VH by the power supply circuit 210. Accordingly, for the pixels 20 that are disposed in the part R2, between the pixel electrodes 21 to which the first electric potential S1 maintained at the low electric potential VL is supplied and the common electrodes 22 to which the common electric potential Vcom maintained at the high electric potential VH are supplied, voltages are applied such that the electric potentials of the common electrodes 22 become higher than those of the pixel electrodes 21. On the other hand, the second electric potential S2 is in the high-impedance state. In other words, in the dark gray color writing step STDG, the switch 95*s* described with reference to FIG. 2 is in the OFF state, and thus, the second control line 95 is in the high-impedance state. Accordingly, in the dark gray color writing step STDG, the pixel electrodes 21 of the pixels 20 disposed in the parts R1, R3, R4, and R5 of the display unit 3 which are electrically connected to the second control line 95 are in the high-impedance state. As a result, in the pixels 20 disposed in the parts R1, R3, R4, and R5, no voltage is applied between the pixel electrodes 21 and the common electrodes 22.

As a result, after the dark gray color writing step STDG, the color displayed by the pixels 20 disposed in the part R2 of the display unit 3 changes from the black color to the dark gray color, and the colors displayed by the pixels 20 disposed in the parts R1, R3, R4, and R5 of the display unit 3 are maintained to be the black colors. Accordingly, a gray scale image 520 (see FIG. 7) of two gray scale levels including the black color and the dark gray color is displayed in the display unit 3.

As shown in FIGS. 6 and 7, in the gray color writing step STG, between the pixel electrodes 21 and the common electrodes 22 of the pixels 20 that are disposed in the part R3 of the display unit 3, a voltage is applied such that the electric potentials of the common electrodes 22 become high relative to those of the pixel electrodes, and no voltage is applied between the pixel electrodes 21 and the common electrodes 22 of the pixels 20 that are disposed in the parts R1, R2, R4, and R5 of the display unit 3.

In particular, by supplying image signals having a low level to the pixels 20 disposed in the part R3, only the first transmission gates 111 (see FIG. 2) are in the ON state. Accordingly, in the pixels disposed in the part R3, the pixel electrodes 21 are electrically connected to the first control line 94, and thus, the first electric potential S1 is supplied to the pixel electrodes 21. In addition, by supplying image signals having a high level to the pixels 20 that are disposed in the parts R1, R2, R4, and R5, only the second transmission gates 112 (see FIG. 2) are in the ON state. Accordingly, in the pixels disposed in the parts R1, R2, R4, and R5, the pixel electrodes 21 are electrically connected to the second control line 95, and thus, the second electric potential S2 is supplied to the pixel electrodes 21. The image data 400G shown in FIG. 7 conceptually represents that the first electric potential S1 is supplied to the pixels 20 disposed in the part R3 and the second electric potential S2 is supplied to the pixels 20 disposed in the parts R1, R2, R4, and R5. At that moment, the first electric potential S1 is maintained at the low electric potential VL by the power supply circuit 210, and the common electric potential Vcom is maintained at the high electric potential VH by the common electric potential supplying circuit 220. In addition, in the gray color writing step STG, the high power supplying electric potential VEP is maintained at the high electric potential VH by the power supply circuit 210. Accordingly, for the pixels 20 that are disposed in the part R3, between the pixel electrodes 21 to which the first electric potential S1 maintained at the low electric potential VL is supplied and the common electrodes 22 to which the common electric potential Vcom maintained at the high electric potential VH are supplied, voltages are applied such that the electric potentials of the common electrodes 22 become higher than those of the pixel electrodes 21. On the other hand, the second electric potential S2 is in the high-impedance state. In other words, in the gray color writing step STG, the switch 95*s* described with reference to FIG. 2 is in the OFF state, and thus, the second control line 95 is in the high-impedance state. Accordingly, in the gray color writing step STG, the pixel electrodes 21 of the pixels 20 disposed in the parts R1, R2, R4, and R5 of the display unit 3 which are electrically connected to the second control line 95 are in the high-impedance state. As a result, in the pixels 20 disposed in the parts R1, R2, R4, and R5, no voltage is applied between the pixel electrodes 21 and the common electrodes 22.

Here, the gray color writing step STG is performed for a period longer than that of the dark gray color writing step STDG. In other words, a time period for which the voltages are applied between the pixel electrodes 21 and the common electrodes 22 of the pixels 20 disposed in the part R3 in the gray color writing step STG is set to be longer than a time period for which the voltages are applied between the pixel electrodes 21 and the common electrodes 22 of the pixels 20 disposed in the part R2 in the dark gray color writing step STDG. Accordingly, the pixels 20 disposed in the part R3 can display a gray color that has a gray scale level brighter than that of the dark gray color in the gray color writing step STG.

As a result, after the gray color writing step STG, the color displayed by the pixels 20 disposed in the part R3 of the display unit 3 changes from the black color to the gray color, the color displayed by the pixels 20 disposed in the parts R1, R4, and R5 of the display unit 3 is maintained to be the black color, and the color of the pixels 20 disposed in the part R2 of the display unit 3 is maintained to be the dark gray color. Accordingly, a gray scale image 530 (see FIG. 7) of three gray scale levels including the black color, the dark gray color, and the gray color is displayed in the display unit 3.

As shown in FIGS. 6 and 7, in the light gray color writing step STLG, between the pixel electrodes 21 and the common electrodes 22 of the pixels 20 that are disposed in the part R4 of the display unit 3, a voltage is applied such that the electric potentials of the common electrodes 22 become high relative to those of the pixel electrodes, and no voltage is applied between the pixel electrodes 21 and the common electrodes 22 of the pixels 20 that are disposed in the parts R1, R2, R3, and R5 of the display unit 3.

In particular, by supplying image signals having a low level to the pixels 20 disposed in the part R4, only the first transmission gates 111 (see FIG. 2) are in the ON state. Accordingly, in the pixels disposed in the part R4, the pixel electrodes 21 are electrically connected to the first control line 94, and thus, the first electric potential S1 is supplied to the pixel electrodes 21. In addition, by supplying image signals having a high level to the pixels 20 that are disposed in the parts R1, R2, R3, and R5, only the second transmission gates 112 (see FIG. 2) are in the ON state. Accordingly, in the pixels disposed in the parts R1, R2, R3, and R5, the pixel electrodes 21 are electrically connected to the second control line 95, and thus, the second electric potential S2 is supplied to the pixel electrodes 21. The image data 400LG shown in FIG. 7 conceptually represents that the first electric potential S1 is supplied to the pixels 20 disposed in the part R4 and the second electric potential S2 is supplied to the pixels 20 disposed in the parts R1, R2, R3, and R5. At that moment, the first electric potential S1 is maintained at the low electric potential VL by the power supply circuit 210, and the common electric potential Vcom is maintained at the high electric potential VH by the common electric potential supplying circuit 220. In addition, in the light gray color writing step STLG, the high power supplying electric potential VEP is maintained at the high electric potential VH by the power supply circuit 210. Accordingly, for the pixels 20 that are disposed in the part R4, between the pixel electrodes 21 to which the first electric potential S1 maintained at the low electric potential VL is supplied and the common electrodes 22 to which the common electric potential Vcom maintained at the high electric potential VH are supplied, voltages are applied such that the electric potentials of the common electrodes 22 become higher than those of the pixel electrodes 21. On the other hand, the second electric potential S2 is in the high-impedance state. In other words, in the light gray color writing step STLG, the switch 95*s* described with reference to FIG. 2 is in the OFF state, and thus, the second control line 95 is in the high-impedance state. Accordingly, in the light gray color writing step STLG, the pixel electrodes 21 of the pixels 20 disposed in the parts R1, R2, R3, and R5 of the display unit 3 which are electrically connected to the second control line 95 are in the high-impedance state. As a result, in the pixels 20 disposed in the parts R1, R2, R3, and R5, no voltage is applied between the pixel electrodes 21 and the common electrodes 22.

Here, the light gray color writing step STLG is performed for a period longer than that of the gray color writing step STG. In other words, a time period for which the voltages are applied between the pixel electrodes 21 and the common electrodes 22 of the pixels 20 disposed in the part R4 in the light gray color writing step STLG is set to be longer than a time period for which the voltages are applied between the pixel electrodes 21 and the common electrodes 22 of the pixels 20 disposed in the part R3 in the gray color writing step STG. Accordingly, the pixels 20 disposed in the part R4 can display a light gray color that has a gray scale level brighter than that of the gray color in the light gray color writing step STLG.

As a result, after the light gray color writing step STLG, the color displayed by the pixels 20 disposed in the part R4 of the display unit 3 changes from the black color to the light gray color, the color displayed by the pixels 20 disposed in the parts R1 and R5 of the display unit 3 is maintained to be the black color, the color of the pixels 20 disposed in the part R2 of the display unit 3 are maintained to be the dark gray color, and the color of the pixels 20 disposed in the part R3 of the display unit 3 are maintained to be the gray color. Accordingly, a gray scale image 540 (see FIG. 7) of four gray scale levels including the black color, the dark gray color, the gray color, and the light gray color is displayed in the display unit 3.

As shown in FIGS. 6 and 7, in the white color writing step STW, between the pixel electrodes 21 and the common electrodes 22 of the pixels 20 that are disposed in the part R5 of the display unit 3, a voltage is applied such that the electric potentials of the common electrodes 22 become high relative to those of the pixel electrodes, and no voltage is applied between the pixel electrodes 21 and the common electrodes 22 of the pixels 20 that are disposed in the parts R1, R2, R3, and R4 of the display unit 3.

In particular, by supplying image signals having a low level to the pixels 20 disposed in the part R5, only the first transmission gates 111 (see FIG. 2) are in the ON state. Accordingly, in the pixels disposed in the part R5, the pixel electrodes 21 are electrically connected to the first control line 94, and thus, the first electric potential S1 is supplied to the pixel electrodes 21. In addition, by supplying image signals having a high level to the pixels 20 that are disposed in the parts R1, R2, R3, and R4, only the second transmission gates 112 (see FIG. 2) are in the ON state. Accordingly, in the pixels disposed in the parts R1, R2, R3, and R4, the pixel electrodes 21 are electrically connected to the second control line 95, and thus, the second electric potential S2 is supplied to the pixel electrodes 21. The image data 400W shown in FIG. 7 conceptually represents that the first electric potential S1 is supplied to the pixels 20 disposed in the part R5 and the second electric potential S2 is supplied to the pixels 20 disposed in the parts R1, R2, R3, and R4. At that moment, the first electric potential S1 is maintained at the low electric potential VL by the power supply circuit 210, and the common electric potential Vcom is maintained at the high electric potential VH by the common electric potential supplying circuit 220. In addition, in the white color writing step STW, the high power supplying electric potential VEP is maintained at the high electric potential VH by the power supply circuit 210. Accordingly, for the pixels 20 that are disposed in the part R5, between the pixel electrodes 21 to which the first electric potential S1 maintained at the low electric potential VL is supplied and the common electrodes 22 to which the common electric potential Vcom maintained at the high electric potential VH are supplied, voltages are applied such that the electric potentials of the common electrodes 22 become higher than those of the pixel electrodes 21. On the other hand, the second electric potential S2 is in the high-impedance state. In other words, in the white color writing step STW, the switch 95*s* described with reference to FIG. 2 is in the OFF state, and thus, the second control line 95 is in the high-impedance state. In other words, in the white color writing step STW, the pixel electrodes 21 of the pixels 20 disposed in the parts R1, R2, R3, and R4 of the display unit 3 which are electrically connected to the second control line 95 are in the high-impedance state. Accordingly, in the pixels 20 disposed in the parts R1, R2, R3, and R4, no voltage is applied between the pixel electrodes 21 and the common electrodes 22.

Here, the white color writing step STW is performed for a period longer than that of the light gray color writing step STLG. In other words, a time period for which the voltages are applied between the pixel electrodes 21 and the common electrodes 22 of the pixels 20 disposed in the part R5 in the white color writing step STW is set to be longer than a time period for which the voltages are applied between the pixel electrodes 21 and the common electrodes 22 of the pixels 20 disposed in the part R4 in the light white color writing step STLG. Accordingly, the pixels 20 disposed in the part R5 can display a white color that has a gray scale level brighter than that of the light white color in the white color writing step STW.

As a result, after the white color writing step STW, the color displayed by the pixels 20 disposed in the part R5 of the display unit 3 changes from the black color to the white color, the color displayed by the pixels 20 disposed in the parts R1 of the display unit 3 is maintained to be the black color, the color of the pixels 20 disposed in the part R2 of the display unit 3 is maintained to be the dark gray color, the color of the pixels 20 disposed in the part R3 of the display unit 3 is maintained to be the gray colors, and the color of the pixels 20 disposed in the part R4 of the display unit 3 is maintained to be the light gray color. Accordingly, a gray scale image 550 (see FIG. 7) of five gray scale levels including the black color, the dark gray color, the gray color, the light gray color, and the white color is displayed in the display unit 3.

As described above, in the image forming step ST10, by sequentially performing the black color writing step STB, the dark gray color writing step STDG, the gray color writing step STG, the light gray color writing step STLG, and the white color writing step STW, the gray scale image 550 of five gray scale levels including the black color, the dark gray color, the gray color, the light gray color, and the white color is displayed in the display unit 3 (in other words, the gray scale image 550 is formed in the display unit 3).

In this embodiment, in the image forming step ST10, first, the whole black image is displayed, and then image data of other gray scale levels is configured to be written. However, for example, after a whole white image is displayed, image data of other gray scale levels may be configured to be written.

As shown in FIG. 6, after the image forming step ST10 is performed, the short interval step ST20 is performed. In the short interval step ST20, the pixel electrodes 21 and the common electrodes 22 of all the pixels 20 of the display unit 3 are in the high-impedance state to be electrically cut off. In particular, in the short interval step ST20, the common electric potential Vcom, the first electric potential S1, the second electric potential S2, and the high power supplying electric potential VEP are in the high-impedance state (Hi-Z). In other words, in the short interval step ST20, the switches 93*s*, 94*s*, 95*s*, and 91*s* that have been described with reference to FIG. 2 are in the OFF state. Accordingly, as the common electric potential line 93, the first control line 94, the second control line 95, and the high-electric potential power line 91 are in the high-impedance state, the pixel electrodes 21 and the common electrodes 22 of all the pixels 20 of the display unit 3 are in the high-impedance state.

The period of the short interval step ST20, for example, is equal to or longer than 200 ms and is equal to or shorter than 5 s. For example, when the period of the short interval step ST20 is longer than 5 s, the reflectance for the black color displayed in a part R1 of the display unit 3 increases, and the reflectance for the white color displayed in a part R5 of the display unit 3 decreases. Accordingly, there is a possibility that the amount of a decrease in the contrast becomes too large. When the black auxiliary pulse inputting step ST30 and the white auxiliary pulse inputting step ST40 that will be described later are performed in the state that the contrast decreases too much as described above, there is a possibility that the change in the contrast (in other words, the change in the reflectance for the black color displayed in the part R1 and the change in the reflectance for the white color displayed in the part R5) is visually recognized by an observer, so that display is viewed to be slightly blinking (also referred to as flashing).

As shown in FIG. 6, after the short interval step ST20 is performed, the black auxiliary pulse inputting step ST30 is performed. In the black auxiliary pulse inputting step ST30, a plurality of black auxiliary pulse writing steps STpb is included.

Figure 8:
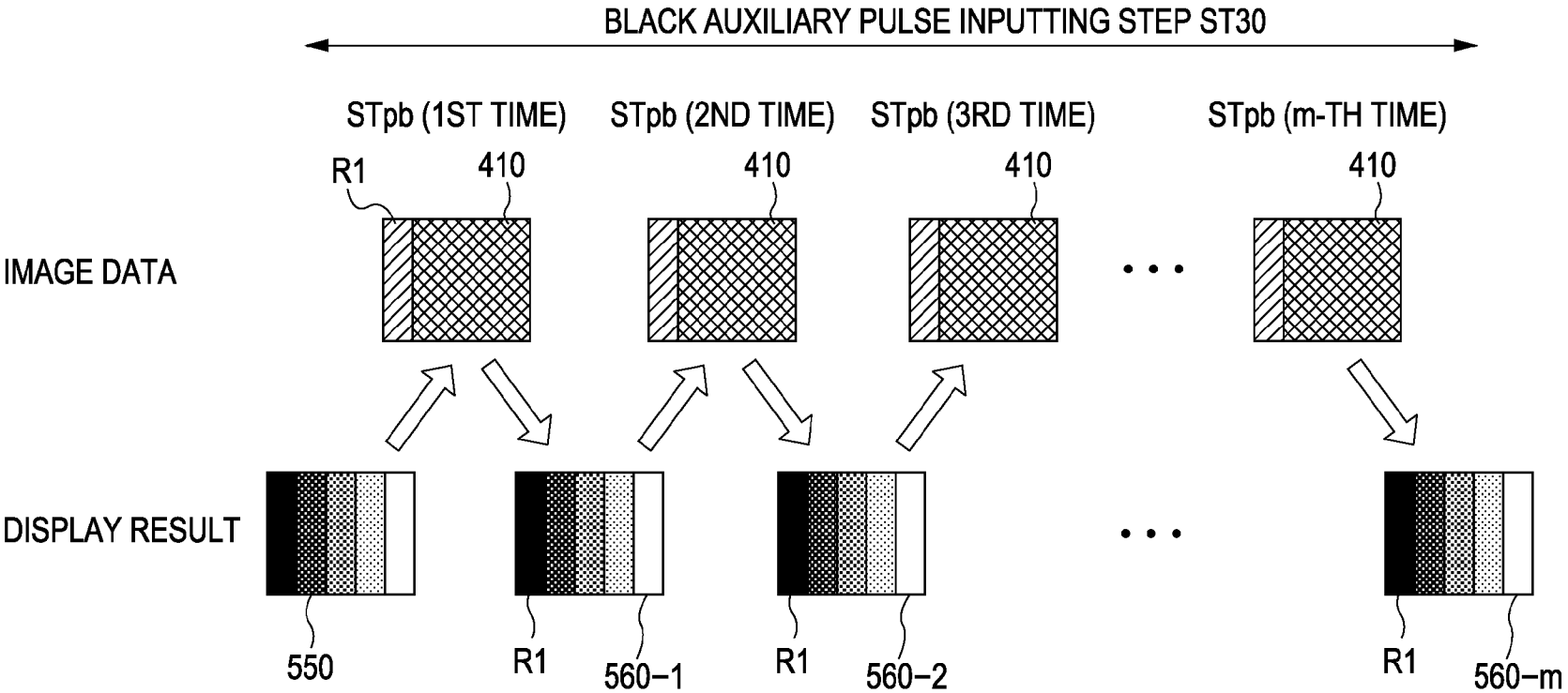
FIG. 8 is a schematic diagram showing image data and display results of a plurality of black auxiliary pulse writing steps.

FIG. 8 is a schematic diagram showing image data and display results of the plurality of black auxiliary pulse writing steps STpb included in the black auxiliary pulse inputting step.

As shown in FIGS. 6 and 8, in the black auxiliary pulse writing step STpb, between the pixel electrodes 21 and the common electrodes 22 of the pixels 20 that are disposed in the part R1 of the display unit 3, a pulse voltage is applied such that the electric potentials of the pixel electrodes 21 become high relative to those of the common electrodes, and no voltage is applied between the pixel electrodes 21 and the common electrodes 22 of the pixels 20 that are disposed in the parts R2, R3, R4, and R5 of the display unit 3.

In particular, by supplying image signals having the low level to the pixels 20 disposed in the part R1, only the first transmission gates 111 (see FIG. 2) are in the ON state. Accordingly, in the pixels 20 disposed in the part R1, the pixel electrodes 21 are electrically connected to the first control line 94, and thus, the first electric potential S1 is supplied to the pixel electrodes 21. In addition, by supplying image signals having the high level to the pixels that are disposed in the parts R2, R3, R4, and R5, only the second transmission gates 112 (see FIG. 2) are in the ON state. Accordingly, in the pixels disposed in the parts R2, R3, R4, and R5, the pixel electrodes 21 are electrically connected to the second control line 95, and thus, the second electric potential S2 is supplied to the pixel electrodes 21. The image data 410 shown in FIG. 8 conceptually represents that the first electric potential S1 is supplied to the pixels 20 disposed in the part R1 and the second electric potential S2 is supplied to the pixels 20 disposed in the parts R2, R3, R4, and R5 in the black auxiliary pulse writing step STpb. At that moment, the first electric potential S1 is maintained at the high electric potential VH by the power supply circuit 210, and the common electric potential Vcom is maintained at the low electric potential VL by the common electric potential supplying circuit 220. In addition, in the black auxiliary pulse writing step STpb, the high power supplying electric potential VEP is maintained at the high electric potential VH by the power supply circuit 210. Accordingly, for the pixels 20 that are disposed in the part R1, between the pixel electrodes 21 to which the first electric potential S1 maintained at the high electric potential VH is supplied and the common electrodes 22 to which the common electric potential Vcom maintained at the low electric potential VL is supplied, pulse voltages are applied such that the electric potentials of the pixel electrodes 21 become higher than those of the common electrodes 22. In other words, in the pixels 20 disposed in the part R1, between the pixel electrodes 21 and the common electrodes 22, a voltage having a same polarity as that of the voltage applied in the black color writing step STB is applied as a pulse. On the other hand, the second electric potential S2 is in the high-impedance state. In other words, in the black auxiliary pulse writing step STpb, the switch 95*s* described with reference to FIG. 2 is in the OFF state, and thus, the second control line 95 is in the high-impedance state. Accordingly, in the black auxiliary pulse writing step STpb, the pixel electrodes 21 of the pixels 20 disposed in the parts R2, R3, R4, and R5 of the display unit 3 which are electrically connected to the second control line 95 are in the high-impedance state. Accordingly, in the pixels 20 disposed in the parts R2, R3, R4, and R5, no voltage is applied between the pixel electrodes 21 and the common electrodes 22.

As a result, the reflectance for the black color displayed in the pixels 20 disposed in the part R1 of the display unit 3 that may increase due to a kickback phenomenon, which may occur right after the above-described black color writing step STB, can be lowered. In addition, in this embodiment, in the black auxiliary pulse inputting step ST30, the plurality of the black auxiliary pulse writing steps STpb is included, and accordingly, the reflectance for the black color displayed in the pixels 20 disposed in the part R1 of the display unit 3 can be lowered more assuredly.

In other words, as shown in FIGS. 7 and 8, the reflectance for the black color displayed in the part R1 can be slowly lowered (in other words, the reflectance for the black color that has increased due to the kickback phenomenon that, which may occur right after the image forming step ST10, can be recovered) in the order of a gray scale image 560-1 displayed after the black auxiliary pulse writing step STpb of the first time, a gray scale image 560-2 displayed after the black auxiliary pulse writing step STpb of the second time, . . . , and a gray scale image 560-*m* displayed after the first black auxiliary pulse writing step STpb of the m-th (where m is a natural number) time.

As shown in FIG. 6, after the black auxiliary pulse inputting step ST30 is performed, the white auxiliary pulse inputting step ST40 is performed. In the white auxiliary pulse inputting step ST40, a plurality of white auxiliary pulse writing steps STpw is included.

Figure 9:
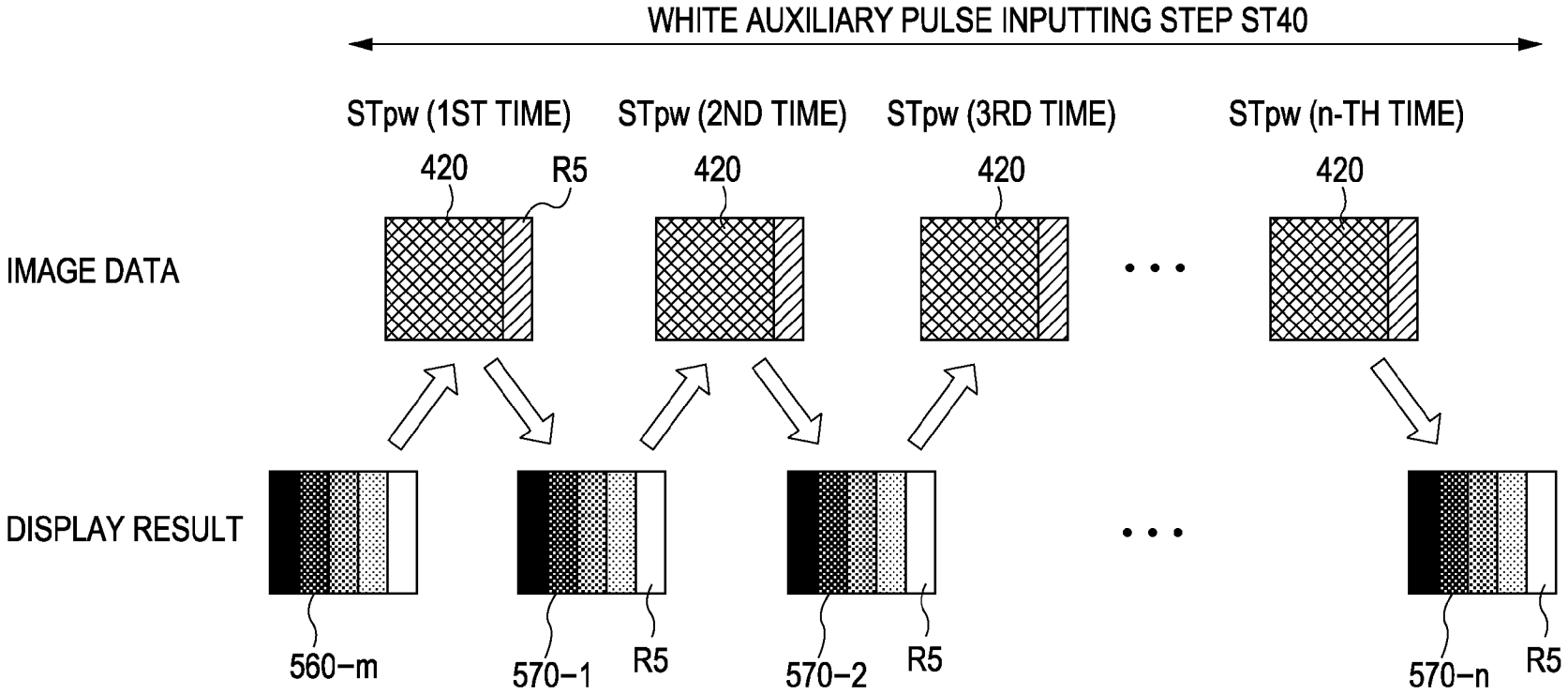
FIG. 9 is a schematic diagram showing image data and display results of a plurality of white auxiliary pulse writing steps.

FIG. 9 is a schematic diagram showing image data and display results of the plurality of white auxiliary pulse writing steps STpw included in the white auxiliary pulse inputting step.

As shown in FIGS. 6 and 9, in the white auxiliary pulse writing step STpw, between the pixel electrodes 21 and the common electrodes 22 of the pixels 20 that are disposed in the part R5 of the display unit 3, a pulse voltage is applied such that the electric potentials of the common electrodes 22 become high relative to those of the pixel electrodes, and no voltage is applied between the pixel electrodes 21 and the common electrodes 22 of the pixels 20 that are disposed in the parts R1, R2, R3, and R4 of the display unit 3.

In particular, by supplying image signals having the low level to the pixels 20 disposed in the part R5, only the first transmission gates 111 (see FIG. 2) are in the ON state. Accordingly, in the pixels 20 disposed in the part R5, the pixel electrodes 21 are electrically connected to the first control line 94, and thus, the first electric potential S1 is supplied to the pixel electrodes 21. In addition, by supplying image signals having the high level to the pixels that are disposed in the parts R1, R2, R3, and R4, only the second transmission gates 112 (see FIG. 2) are in the ON state. Accordingly, in the pixels disposed in the parts R1, R2, R3, and R4, the pixel electrodes 21 are electrically connected to the second control line 95, and thus, the second electric potential S2 is supplied to the pixel electrodes 21. The image data 420 shown in FIG. 9 conceptually represents that the first electric potential S1 is supplied to the pixels 20 disposed in the part R5 and the second electric potential S2 is supplied to the pixels 20 disposed in the parts R1, R2, R3, and R4. At that moment, the first electric potential S1 is maintained at the low electric potential VL by the power supply circuit 210, and the common electric potential Vcom is maintained at the high electric potential VH by the common electric potential supplying circuit 220. In addition, in the white auxiliary pulse writing step STpw, the high power supplying electric potential VEP is maintained at the high electric potential VH by the power supply circuit 210. Accordingly, for the pixels 20 that are disposed in the part R5, between the pixel electrodes 21 to which the first electric potential S1 maintained at the low electric potential VL is supplied and the common electrodes 22 to which the common electric potential Vcom maintained at the high electric potential VH is supplied, pulse voltages are applied such that the electric potentials of the common electrodes 22 become higher than those of the pixel electrodes 21. In other words, in the pixels 20 disposed in the part R5, between the pixel electrodes 21 and the common electrodes 22, a voltage having a same polarity as that of the voltage applied in the black color writing step STW is applied as a pulse. On the other hand, the second electric potential S2 is in the high-impedance state. In other words, in the white auxiliary pulse writing step STpw, the switch 95*s* described with reference to FIG. 2 is in the OFF state, and thus, the second control line 95 is in the high-impedance state. Accordingly, in the white auxiliary pulse writing step STpw, the pixel electrodes 21 of the pixels 20 disposed in the parts R1, R2, R3, and R4 of the display unit 3 which are electrically connected to the second control line 95 are in the high-impedance state. Accordingly, in the pixels 20 disposed in the parts R1, R2, R3, and R4, no voltage is applied between the pixel electrodes 21 and the common electrodes 22.

As a result, the reflectance for the white color displayed in the pixels 20 disposed in the part R5 of the display unit 3 that may decrease due to a kickback phenomenon, which may occur right after the above-described white color writing step STW, can increase. In addition, in this embodiment, in the white auxiliary pulse inputting step ST40, the plurality of the white auxiliary pulse writing steps STpw is included, and accordingly, the reflectance for the white color displayed in the pixels 20 disposed in the part R5 of the display unit 3 can increase more assuredly.

In other words, as shown in FIGS. 7 and 9, the reflectance for the white color displayed in the part R5 can slowly increase (in other words, the reflectance for the white color that has decreased due to the kickback phenomenon, which may occur right after the image forming step ST10, can be recovered) in the order of a gray scale image 570-1 displayed after performing the white auxiliary pulse writing step STpw for the first time, a gray scale image 570-2 displayed after performing the white auxiliary pulse writing step STpw of the second time, . . . , and a gray scale image 570-*n* displayed after performing the first white auxiliary pulse writing step STpw of the n-th (where n is a natural number) time.

As described above, according to the method of driving the electrophoretic display device of this embodiment, the reflectance for the black color displayed in the display unit 3 can decrease by performing the black auxiliary pulse inputting step ST30, and the reflectance for the white color displayed in the display unit 3 can increase by performing the white auxiliary pulse inputting step ST40. Accordingly, the contrast of the gray scale image displayed in the display unit 3 can be improved. As a result, a gray scale image having the high quality can be displayed.

In addition, according to this embodiment, in particular, the black auxiliary pulse inputting step ST30 and the white auxiliary pulse inputting step ST40 are performed within a relatively short time interval (for example, that is equal to or longer than 200 ms and is equal to or shorter than 5 s after the short interval step ST20) after the gray scale image 550 is displayed in the image forming step ST10. Accordingly, it can be suppressed or prevented that an image having the contrast decreased due to the kickback phenomenon, which may occur right after the image forming step ST10, is displayed more assuredly.

In addition, according to this embodiment, in particular, the black auxiliary pulse inputting step ST30 and the white auxiliary inputting step ST40 are performed after the image forming step ST10 is performed. Accordingly, the gray scale image 550 can be displayed in a relatively short time by performing the image forming step ST10, and thereby stress due to a long time interval until display of an image to an observer who watches the gray scale image displayed in the display unit 3 is scarcely or not given. In other words, by displaying the gray scale image 550 in the display unit 3 in the image forming step ST10, a state in which the observer can recognize almost the entirety of the gray scale image is formed. Thereafter, the contrast of the gray scale image can be improved by the black auxiliary pulse inputting step ST30 and the white auxiliary pulse inputting step ST40, and accordingly, an image with the high quality can be displayed with scarcely causing or without causing stress to the observer.

In the descriptions above, the low power supplying electric potential Vss has been described to be fixed to the low electric potential VL (for example, 0 V). However, the low power supplying electric potential Vss may be changed to be in the high-impedance state. In particular, in FIG. 6, in the image data generating period Tw and the short interval step ST20, the low power supplying electric potential Vss may be in the high-impedance state. As a result, the load of the power supply circuit 210 can be reduced.

Next, the temporal change of the reflectance of the display unit in a case where the above-described method of driving the electrophoretic display device is used will be described with reference FIG. 10.

Figure 10:
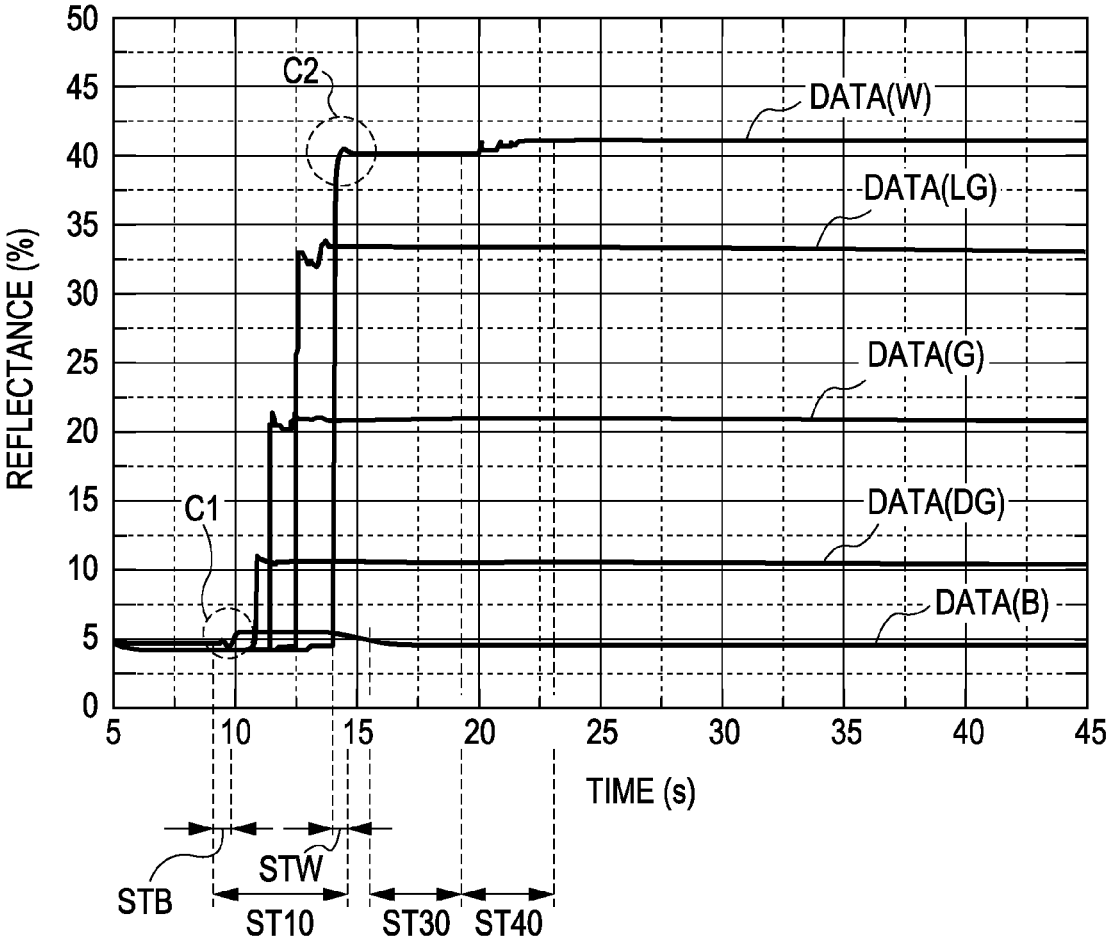
FIG. 10 is a graph showing a measured result of the temporal change of the reflectance of the display unit in a case in which the method of driving the electrophoretic display device according to the first embodiment is used.

FIG. 10 is a graph showing a measured result of the temporal change of the reflectance of the display unit in the case the method of driving the electrophoretic display device according to this embodiment is used.

FIG. 10 is the result measured under the environment at the temperature of 25±2.5° C. and the relative humidity of 65±20% Rh.

In FIG. 10, data DATA(B) represents the reflectance of the part R1 in which the black color is displayed, data DATA(DG) represents the reflectance of the part R2 in which the dark gray color is displayed, and data DATA(G) represents the reflectance of the part R3 in which the gray color is displayed. In addition, data DATA(LG) represents the reflectance of the part R4 in which the light gray color is displayed, and data DATA(W) represents the reflectance of the part R5 in which the white color is displayed.

As shown in a part of the data DATA(B) which is surrounded by a dotted line C1 shown in FIG. 10, the reflectance decreases right after the black color writing step STB of the image forming step ST10, and then, the reflectance increases due to the kickback phenomenon.

However, as shown in the data DATA(B) of FIG. 10, according to this embodiment, particularly, the reflectance of the part R1 in which the black color is displayed can decrease by the black auxiliary pulse inputting step ST30. In other words, the reflectance that has increased due to the kickback phenomenon after the black color writing step STB of the image forming step ST10 can decrease (return) slowly by performing the black auxiliary pulse inputting step ST30.

As shown in a part of the data DATA(W) of FIG. 10 which is surrounded by a dotted line C2, the reflectance increases right after the white color writing step STW of the image forming step ST10, and then, the reflectance decreases due to the kickback operation.

However, as shown by the data DATA(W) in FIG. 10, according to this embodiment, in particular, the reflectance of the part R5 in which the white color is displayed can increase by performing the white auxiliary pulse inputting step ST40. In other words, the reflectance that has decreased after the white color writing step STW of the image forming step ST10 due to the kickback phenomenon can increase (return) slowly by performing the white auxiliary pulse inputting step ST40.

As described above, according to the method of driving the electrophoretic display device according to this embodiment, the reflectance of the part R1 in which the black color is displayed can decrease by the black auxiliary pulse inputting step ST30. In addition, the reflectance of the part R5 in which the white color is displayed can increase by the white auxiliary pulse inputting step ST40. As a result, the contrast of the gray scale image displayed in the display unit 3 can be improved.

Second Embodiment

A method of driving an electrophoretic display device according to a second embodiment of the invention will be described with reference to FIG. 11.

Figure 11:
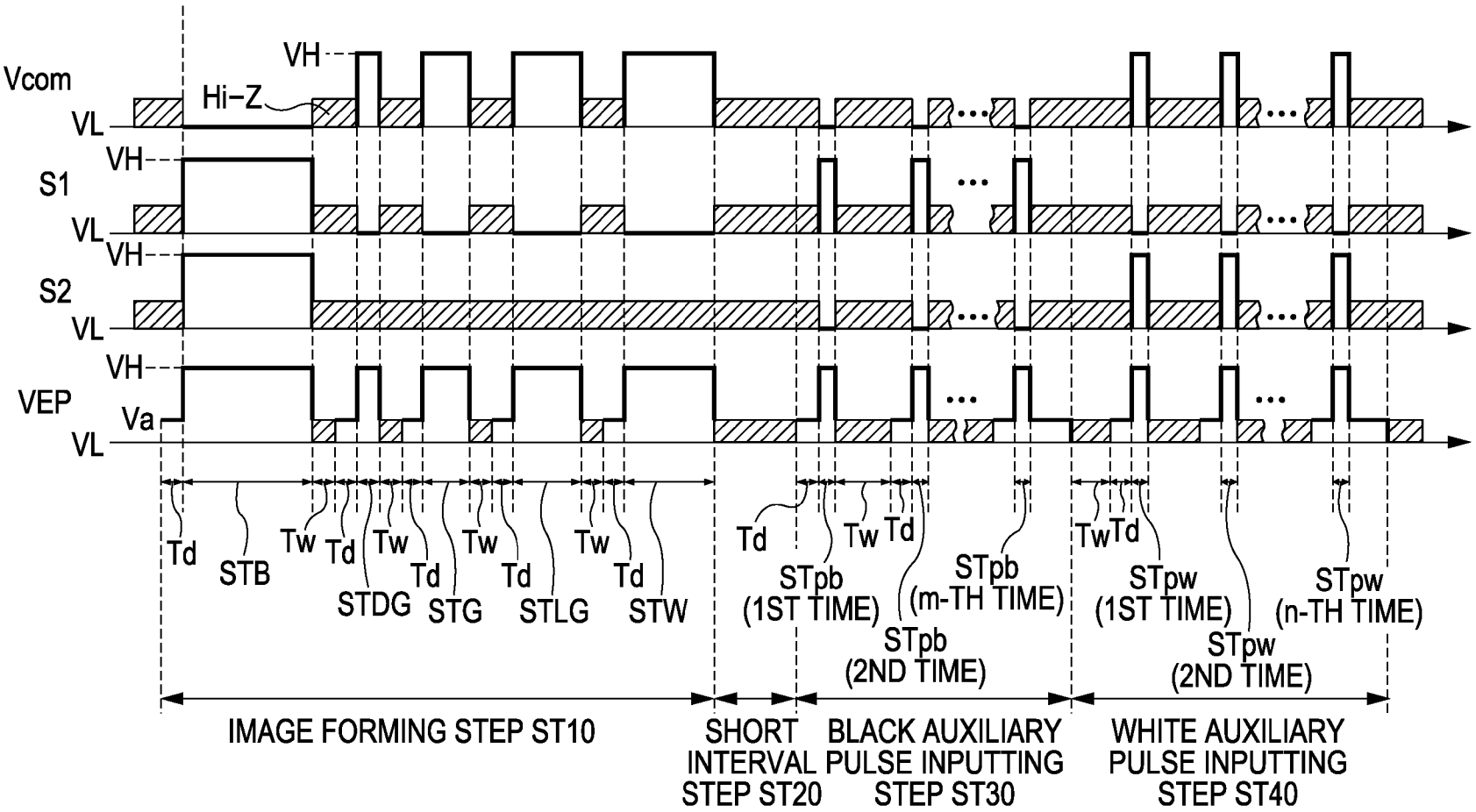
FIG. 11 is a timing chart showing a method of driving an electrophoretic display device according to a second embodiment of the invention.

FIG. 11 is a timing chart showing the method of driving an electrophoretic display device according to the second embodiment.

As shown in FIG. 11, a difference between the method of driving an electrophoretic display device according to the second embodiment and the method of driving an electrophoretic display device according to the first embodiment described above with reference to FIG. 6 is that the common electric potential Vcom and the second electric potential S2 are synchronized with each other in the black auxiliary pulse inputting step ST30 and the white auxiliary pulse inputting step ST40 in the method according to the second embodiment. Other features of the method according to the second embodiment are almost the same as those according to the above-described first embodiment.

As shown in FIG. 11, according to the method of driving the electrophoretic display device according to the second embodiment, in the black auxiliary pulse inputting step ST30 and the white auxiliary pulse inputting step ST40, the common electric potential Vcom and the second electric potential S2 are synchronized with each other.

In particular, in FIG. 11, in each of the plurality of the black auxiliary pulse writing steps STpb included in the black auxiliary pulse inputting step ST30, as in the above-described method of driving the electrophoretic display device according to the first embodiment, by supplying an image signal having the low level to pixels 20 disposed in the part R1, only the first transmission gates 111 (see FIG. 2) are in the ON state. Accordingly, in the pixels 20 disposed in the part R1, the pixel electrode 21 is electrically connected to the first control line 94, and the first electric potential S1 is supplied to the pixel electrode 21. In addition, by supplying an image signal having the high level to pixels 20 disposed in parts R2, R3, R4, and R5, only the second transmission gates 112 (see FIG. 2) are in the ON state. Accordingly, in the pixels disposed in parts R2, R3, R4, and R5, the pixel electrodes 21 are electrically connected to the second control line 95, and the second electric potential S2 is supplied to the pixel electrodes 21. At that moment, the first electric potential S1 is maintained at the high electric potential VH by the power supply circuit 210, and the common electric potential Vcom is maintained at the low electric potential VL by the common electric potential supplying circuit 220. In addition, in the black auxiliary pulse writing step STpb, the high power supplying electric potential VEP is maintained at the high electric potential VH by the power supply circuit 210. Accordingly, for the pixels 20 that are disposed in the part R1, between the pixel electrodes 21 to which the first electric potential S1 maintained at the high electric potential VH is supplied and the common electrodes 22 to which the common electric potential Vcom maintained at the low electric potential VL is supplied, pulse voltages are applied such that the electric potentials of the pixel electrodes 21 become higher than those of the common electrodes 22.

In addition, at that moment, according to this embodiment, particularly, the second electric potential S2 is maintained at the low electric potential VL by the power supply circuit 210 so as to be synchronized (or tuned) with the common electric potential Vcom. In other words, in the black auxiliary pulse inputting step ST30, the second electric potential S2 is alternately switched between the high-impedance state and the low electric potential VL with the same period as that of the common electric potential Vcom. Accordingly, in the black auxiliary pulse writing step STpb, the pixel electrodes 21 of the pixels 20 disposed in the parts R2, R3, R4, and R5 of the display unit 3 electrically connected to the second control line 95 are in synchronization with the common electric potential Vcom that is supplied to the common electrode 22 to be the low electric potential VL. As a result, application of an unnecessary voltage between the pixel electrodes 21 and the common electrodes 22 of the pixels 20 disposed in the parts R2, R3, R4, and R5 can be prevented.

In FIG. 11, in each of the plurality of the white auxiliary pulse writing steps STpw included in the white auxiliary pulse inputting step ST40, as in the above-described method of driving the electrophoretic display device according to the first embodiment, by supplying an image signal having the low level to pixels 20 disposed in the part R5, only the first transmission gates 111 are in the ON state. Accordingly, in the pixels 20 disposed in the part R5, the pixel electrode 21 is electrically connected to the first control line 94, and the first electric potential S1 is supplied to the pixel electrode 21. In addition, by supplying an image signal having the high level to pixels 20 disposed in parts R1, R2, R3, and R4, only the second transmission gates 112 are in the ON state. Accordingly, in the pixels disposed in parts R1, R2, R3, and R4, the pixel electrodes 21 are electrically connected to the second control line 95, and the second electric potential S2 is supplied to the pixel electrodes 21. At that moment, the first electric potential S1 is maintained at the low electric potential VL by the power supply circuit 210, and the common electric potential Vcom is maintained at the high electric potential VH by the common electric potential supplying circuit 220. In addition, in the white auxiliary pulse writing step STpw, the high power supplying electric potential VEP is maintained at the high electric potential VH by the power supply circuit 210. Accordingly, for the pixels 20 that are disposed in the part R5, between the pixel electrodes 21 to which the first electric potential S1 maintained at the low electric potential VL is supplied and the common electrodes 22 to which the common electric potential Vcom maintained at the high electric potential VH is supplied, pulse voltages are applied such that the electric potentials of the common electrodes 22 become higher than those of the pixel electrodes 21.

In addition, at that moment, according to this embodiment, particularly, the second electric potential S2 is maintained at the high electric potential VH by the power supply circuit 210 so as to be synchronized (or tuned) with the common electric potential Vcom. In other words, in the white auxiliary pulse inputting step ST40, the second electric potential S2 is alternately switched between the high-impedance state and the high electric potential VH with the same period as that of the common electric potential Vcom. Accordingly, in the white auxiliary pulse writing step STpw, the pixel electrodes 21 of the pixels 20 disposed in the parts R1, R2, R3, and R4 of the display unit 3 electrically connected to the second control line 95 are in synchronization with the common electric potential Vcom that is supplied to the common electrode 22 to be the high electric potential VH. As a result, application of an unnecessary voltage between the pixel electrodes 21 and the common electrodes 22 of the pixels 20 disposed in the parts R1, R2, R3, and R4 can be prevented.

Third Embodiment

A method of driving an electrophoretic display device according to a third embodiment of the invention will be described with reference to FIG. 12.

Figure 12:
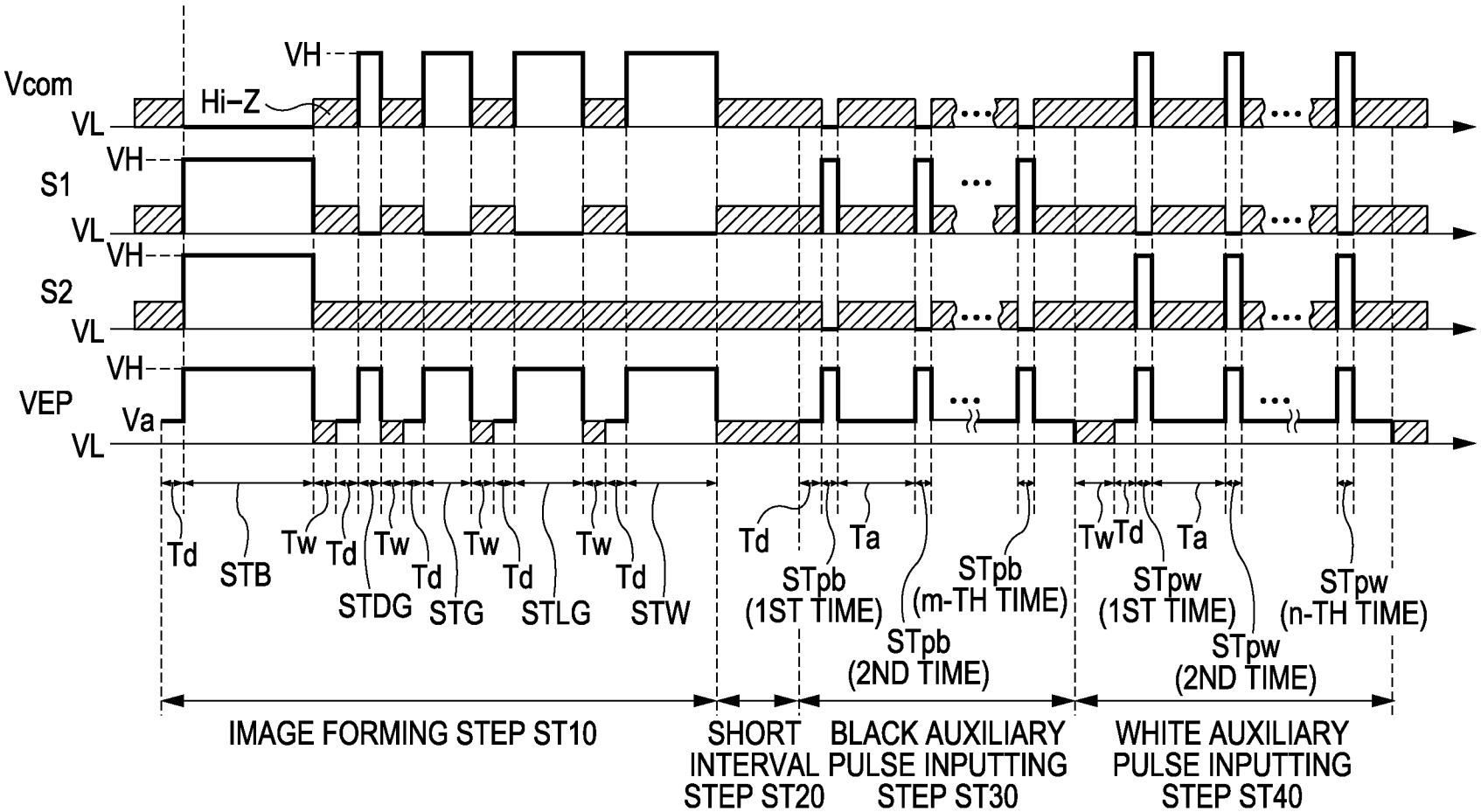
FIG. 12 is a timing chart showing a method of driving an electrophoretic display device according to a third embodiment of the invention.

FIG. 12 is a timing chart showing the method of driving an electrophoretic display device according to the third embodiment.

As shown in FIG. 12, a difference between the method of driving an electrophoretic display device according to the third embodiment and the method of driving an electrophoretic display device according to the second embodiment described above with reference to FIG. 11 is that, between the plurality of the black auxiliary pulse writing steps STpb and between the plurality of the white auxiliary pulse writing steps STpw, the high power supplying electric potential VEP is maintained at an electric potential Va (for example, 5 V) that is lower than the high electric potential VH (for example, 15

V) and is higher than the low electric potential VL (for example, 0 V) in the third embodiment. The other features of the method according to the third embodiment are almost the same as those according to the above-described second embodiment.

As shown in FIG. 12, according to this embodiment, particularly, in a period Ta between the plurality of the black auxiliary pulse writing steps STpb included in the black auxiliary pulse inputting step ST30, the high power supplying electric potential VEP is maintained at the electric potential Va that is lower than the high electric potential VH and is higher than the low electric potential VL. Accordingly, the image data (more particularly, an image signal on the basis of the image data supplied to the memory circuit 25 of each pixel 20) transmitted to each pixel 20 in the image data transmitting period Td right prior to the first black auxiliary pulse writing step STpb can be maintained to be stored in the memory circuit 25 until the m-th black auxiliary pulse writing step STpb is completed. Accordingly, in the black auxiliary pulse inputting step ST30, transmission of the image data to the memory circuit 25 of each pixel 20 a plurality of times can be avoided (in other words, according to the driving methods according to the first and second embodiments, in the black auxiliary pulse inputting step STpb, although a plurality of the image data transmitting periods Tb is needed to be arranged, according to this embodiment, only one image data transmitting period Td is needed to be arranged only just prior to the first black auxiliary pulse writing step STpb), and the power consumption required for transmission of the image data to each pixel 20 can be reduced. In addition, the power consumption required for transmission of the image data to each pixel 20 is higher than that required for supplying the high power supplying electric potential VEP of the electric potential Va to the memory circuit 25.

As shown in FIG. 12, according to this embodiment, particularly, in a period Ta between the plurality of the white auxiliary pulse writing steps STpw included in the white auxiliary pulse inputting step ST40, the high power supplying electric potential VEP is maintained at the electric potential Va that is lower than the high electric potential VH and is higher than the low electric potential VL. Accordingly, the image data transmitted to each pixel 20 in the image data transmitting period Td right prior to the first white auxiliary pulse writing step STpw can be maintained to be stored in the memory circuit 25 until the n-th white auxiliary pulse writing step STpw is completed. Accordingly, in the white auxiliary pulse inputting step ST40, transmission of the image data to the memory circuit 25 of each pixel 20 a plurality of times can be avoided (in other words, according to the driving methods according to the first and second embodiments, in the white auxiliary pulse inputting step ST40, although a plurality of the image data transmitting periods Tb is needed to be arranged, according to this embodiment, only one image data transmitting period Td is needed to be arranged only right prior to the first white auxiliary pulse writing step STpw), and the power consumption required for transmission of the image data to each pixel 20 can be reduced.

Electronic Apparatus

Next, electronic apparatuses in which the above-described electrophoretic display device is used will be described with reference to FIGS. 13 and 14. Hereinafter, cases where the above-described electrophoretic display devices are used in an electronic paper sheet and an electronic notebook will be described as examples.

Figure 13:
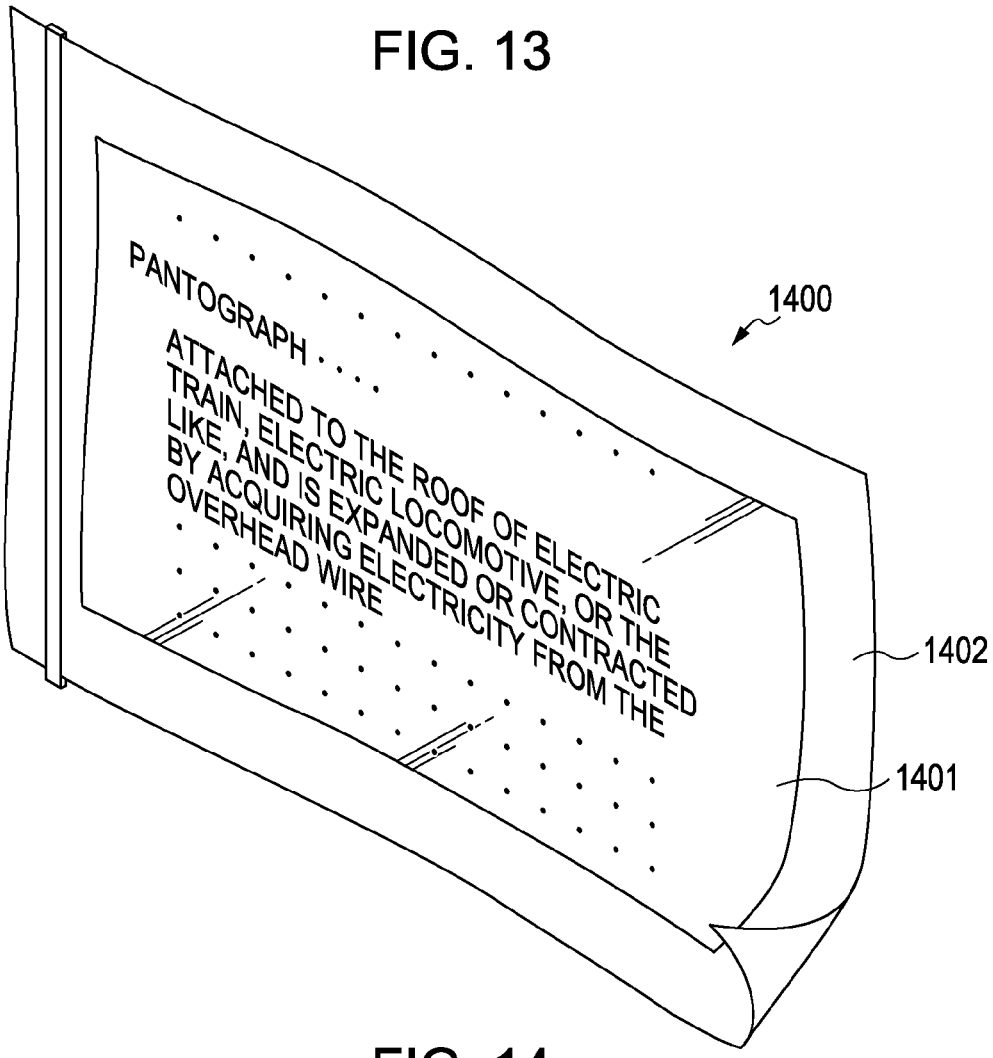
FIG. 13 is a perspective view showing the configuration of an electronic paper sheet that is an example of an electronic apparatus in which the electrophoretic display device is used.

FIG. 13 is a perspective view showing the configuration of an electronic paper sheet 1400.

As shown in FIG. 13, the electronic paper sheet 1400 includes the electrophoretic display device according to each of the above-described embodiments as a display unit 1401. The electronic paper sheet 1400 has flexibility and is configured to include a main body 1402 formed of a rewritable sheet having same texture and flexibility as those of a general paper sheet.

Figure 14:
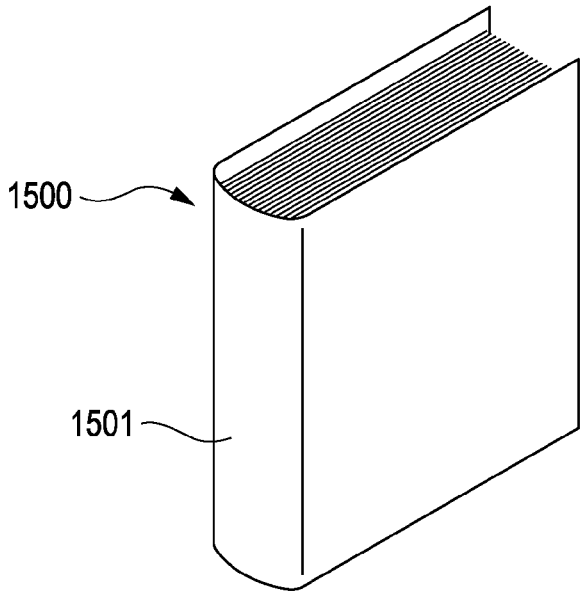
FIG. 14 is a perspective view showing the configuration of an electronic notebook that is an example of an electronic apparatus in which the electrophoretic display device is used.

FIG. 14 is a perspective view showing the configuration of an electronic notebook 1500.

As shown in FIG. 14, the electronic notebook 1500 is formed by binding a plurality of the electronic paper sheets 1400 shown in FIG. 13 and inserting the electronic paper sheets into a cover 1501. The cover 1501 includes a display data inputting unit that receives display data (not shown), for example, transmitted from an external apparatus. Accordingly, the content of display can be changed or updated in accordance with the display data in a state that the electronic paper sheets are bound.

In the electronic paper sheet 1400 and the electronic notebook 1500 described above, the electrophoretic display device according to the above-described embodiment is included, and thereby display of a high-quality image can be performed with low power consumption.

In addition, in a display unit of an electronic apparatus such as a wrist watch, a cellular phone, or a mobile instrument, the electrophoretic display device according to the above-described embodiment can be used.

The invention is not limited to the above-described embodiments, and the embodiments may be appropriately changed without departing from the scope of the gist or idea of the invention which can be read from the Claims and descriptions here. Thus, a method of driving an electrophoretic display device and an electrophoretic device that have such changes therein, and an electronic apparatus that is configured to include the electrophoretic display device belongs to the technical scope of the invention.

The entire disclosure of Japanese Patent Application No. 2008-023029, filed Feb. 1, 2008 is expressly incorporated by reference herein.

What is claimed is:

1. A method of driving an electrophoretic display device having a display unit including a plurality of pixels in which electrophoretic elements each including electrophoretic particles are disposed between a plurality of pixel electrodes and a common electrode that face each other, the plurality of pixels including a first pixel, a second pixel and a third pixel, the plurality of pixel electrodes including a first pixel electrode corresponding to the first pixel, a second pixel electrode corresponding to the second pixel and a third, pixel electrode corresponding to the third pixel, the method comprising:

during an image forming period for forming a gray scale image in the display unit in accordance with image data that has three or more gray scale levels:

applying a first voltage between the plurality of pixel electrodes, including the first pixel electrode, and the common electrode to display one of a highest gray scale level and a lowest gray scale level in the three or more gray scale levels at the plurality of pixels including the first pixel, subsequently applying a second voltage between the second pixel electrode and the common electrode to display a gray scale level between the lowest gray scale level and the highest gray scale level at the second pixel, and subsequently applying a third voltage between the third pixel electrode and the common electrode to display the other of the highest gray scale level and the lowest gray scale level at the third pixel;

during an interval period after forming the gray scale image, having each of the first pixel electrode, the second pixel electrode, the third pixel electrode and the common electrode in a high-impedance state;

after having each of the first pixel electrode, the second pixel electrode, the third pixel electrode and the common electrode in the high-impedance state, applying a first auxiliary pulse voltage that has a same first polarity as one of the first voltage and the third voltage between a corresponding one of the first pixel electrode and the third pixel electrode, respectively, and the common electrode and a period for applying the first auxiliary pulse voltage is shorter than a period for applying the one of the first voltage and the third voltage; and subsequently after having each of the first pixel electrode, the second pixel electrode, third pixel electrode and the common electrode in the high impedance state, applying a second auxiliary pulse voltage that has a same second polarity as the other of the first voltage and the third voltage between the corresponding other of the first pixel electrode and the third pixel electrode, respectively, and the common electrode and a period for applying the second auxiliary pulse voltage is shorter than a period for applying the other of the first voltage and the third voltage, wherein the second electrode is maintained in the high impedance state while the first and second auxiliary pulse voltages are applied to the corresponding first and third pixel electrodes.

2. The method according to claim 1, wherein the second pixel electrode and the common electrode to which the image data having the gray scale level is applied are electrically synchronized with each other while the first and second auxiliary pulse voltages are applied to the corresponding first and third pixel electrodes.

3. The method according to claim 1, wherein the electrophoretic display device has a memory circuit including Static Random Access Memories is electrically connected to the first pixel electrode, and the memory circuit stores image signals supplied to the first pixel electrode in accordance with supply of a power supply voltage, and wherein the first auxiliary pulse voltage is repeatedly applied between the corresponding one of the first pixel electrode and the third pixel electrode, and the power supply voltage, which is lower than the first auxiliary pulse voltage, is supplied to the memory circuit for a period that does not overlap with the period for applying the first auxiliary pulse voltage.

4. The method according to claim 1, wherein the electrophoretic display device has a memory circuit including Static Random Access Memories is electrically connected to the third pixel electrode, and the memory circuit stores image signals supplied to the third pixel electrode in accordance with supply of a power supply voltage, and wherein the second auxiliary pulse voltage is repeatedly applied between the corresponding other of the first pixel electrode and the third pixel electrode, and the power supply voltage, which is lower than the second auxiliary pulse voltage, is supplied to the memory circuit for a period that does not overlap with the period for applying the second auxiliary pulse voltage.

5. An electrophoretic display device that is driven by the method according to claim 1.

6. An electronic apparatus including the electrophoretic display device according to claim 5.

7. The method according to claim 1, wherein the first auxiliary pulse voltage is repeatedly applied to the corresponding one of the first pixel electrode and the third pixel electrode and the common electrode before the second auxiliary pulse voltage is applied to the corresponding other of the first pixel electrode and the third pixel electrode and the common electrode.

8. The method according to claim 7, wherein the second auxiliary pulse voltage is repeatedly applied to the corresponding other of the first pixel electrode and the third pixel electrode and the common electrode after the first auxiliary pulse voltage is applied to the corresponding one of the first pixel electrode and the third pixel electrode and the common electrode.

9. The method according to claim 1, wherein the second auxiliary pulse voltage is repeatedly applied to the corresponding other of the first pixel electrode and the third pixel electrode and the common electrode after the first auxiliary pulse voltage is applied to the corresponding one of the first pixel electrode and the third pixel electrode and the common electrode.

* * * * *